US010516217B2

(12) United States Patent
Fujita et al.

(10) Patent No.: US 10,516,217 B2
(45) Date of Patent: Dec. 24, 2019

(54) ANTENNA APPARATUS

(71) Applicant: DENSO CORPORATION, Kariya, Aichi-pref. (JP)

(72) Inventors: Akihisa Fujita, Anjo (JP); Asahi Kondo, Kariya (JP); Shin-ichiro Matsuzawa, Nisshin (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 100 days.

(21) Appl. No.: 15/493,679

(22) Filed: Apr. 21, 2017

(65) Prior Publication Data

US 2017/0222328 A1 Aug. 3, 2017

Related U.S. Application Data

(62) Division of application No. 14/778,981, filed as application No. PCT/JP2014/057708 on Mar. 20, 2014, now abandoned.

(30) Foreign Application Priority Data

Mar. 22, 2013 (JP) ..... 2013-059230
Mar. 22, 2013 (JP) ..... 2013-060316

(51) Int. Cl.
*H01Q 1/52* (2006.01)
*H01Q 15/18* (2006.01)
(Continued)

(52) U.S. Cl.
CPC ..... *H01Q 17/001* (2013.01); *H01Q 1/526* (2013.01); *H01Q 15/18* (2013.01); *H01Q 19/10* (2013.01);
(Continued)

(58) Field of Classification Search
CPC ..... H01Q 15/14; H01Q 15/18; H01Q 15/20; H01Q 19/10; H01Q 19/104; H01Q 19/106;
(Continued)

(56) References Cited

U.S. PATENT DOCUMENTS 5,977,914 A 11/1999 Harano
6,388,622 B1 * 5/2002 Jennetti ..... H01Q 1/246 343/700 MS
(Continued)

FOREIGN PATENT DOCUMENTS

JP H04-120903 A 4/1992
JP H09-307343 A 11/1997
(Continued)

OTHER PUBLICATIONS

International Search Report (translated version); International Application No. PCT/JP2014/057708, filed Mar. 20, 2014; 3 pages.

*Primary Examiner* — Daniel Munoz
*Assistant Examiner* — Patrick R Holecek
(74) *Attorney, Agent, or Firm* — Knobbe, Martens, Olson & Bear, LLP

(57) ABSTRACT

An antenna apparatus has a dielectric substrate and conductors. The antenna apparatus includes an antenna element which is arranged on a main surface of the dielectric substrate and has directivity ahead of the main surface, and a directional characteristic control member which includes a sidewall part which projects ahead of the main surface on at least one side of directivity of the antenna element with respect to the antenna element, and a roof part which projects in a direction of the antenna element from the sidewall part at a predetermined angle of more than 70° and less than 120° with respect to the sidewall part so that
(Continued)

orthogonal projection to the main surface does not reach the antenna element, to reflect or absorb radio waves.

7 Claims, 23 Drawing Sheets

(51) Int. Cl.
*H01Q 19/10* (2006.01)
*H01Q 17/00* (2006.01)
*H01Q 19/185* (2006.01)
*H01Q 21/06* (2006.01)

(52) U.S. Cl.
CPC ..... *H01Q 19/106* (2013.01); *H01Q 19/185* (2013.01); *H01Q 21/065* (2013.01)

(58) Field of Classification Search
CPC .... H01Q 19/108; H01Q 19/18; H01Q 19/185; H01Q 17/001; H01Q 1/52; H01Q 1/521; H01Q 1/523; H01Q 1/525; H01Q 1/526; H01Q 1/246; H01Q 21/0006; H01Q 21/0075; H01Q 21/0081
See application file for complete search history.

(56) References Cited

U.S. PATENT DOCUMENTS

| | | | | |
|---|---|---|---|---|
| 7,339,544 | B2 * | 3/2008 | Jeung | H01Q 1/246 343/754 |
| 8,593,369 | B2 * | 11/2013 | Storz | H01Q 1/1207 343/700 MS |
| 2003/0184491 | A1 | 10/2003 | Jocher | |
| 2010/0127939 | A1 * | 5/2010 | Yusa | H01Q 9/0407 343/700 MS |

FOREIGN PATENT DOCUMENTS

| | | | |
|---|---|---|---|
| JP | 2001-127523 | A | 5/2001 |
| JP | 3467990 | B2 | 11/2003 |
| JP | 2009-168778 | A | 7/2009 |
| JP | 2012-004700 | A | 1/2012 |
| WO | 2014/148597 | A1 | 9/2014 |

* cited by examiner

DIRECTIVITY OF UNDESIRED RADIATION SOURCE

DIRECTIVITY OF WHOLE TRANSMITTNG ANTENNA PART

ANTENNA APPARATUS

TECHNICAL FIELD

The present invention relates to an antenna apparatus.

BACKGROUND ART

Techniques described in the following patent Literatures 1 to 3 are known as mechanisms for suppressing sidelobe levels in directional characteristics of an antenna. The Patent Literature 1 discloses a configuration in which a metal wall and a wave absorber are vertically provided on a substrate and around a quadrangular antenna element. In addition, the patent Literature 2 discloses an antenna in which a plurality of waveguide slot antennas extending in the first axis direction are arranged in the second axis direction perpendicular to the first axis direction. In this construction, a metal plate is projected in the third axis direction perpendicular to the first axis and the second axis and between the adjacent waveguide slot antennas. In addition, the patent Literature 3 discloses a structure in which a metal cover is projected in the radiation direction of electromagnetic waves and around a patch antenna. In the conventional arts, a metal plate, which projects in the radiation direction of electromagnetic waves, is provided on the above substrate to control directivity.

In addition, as a method of controlling antenna directivity in a radio wave radar, a technique is known in which a guide configured by a metal wall or the like is provided beside a radiation element to reduce a sidelobe level (e.g. refer to Patent Literature 2).

CITATION LIST

Patent Literature

[Patent Literature 1] Japanese Patent No. 3467990
[Patent Literature 2] JP-A-2012-4700
[Patent Literature 3] JP-A-2009-168778

SUMMARY OF INVENTION

Technical Problem

However, according to the techniques in the patent literature 1 to 3, a metal body projects in the direction of 0° of directional characteristics, that is, in the direction perpendicular to a main surface of the substrate board on which antenna elements are arranged. Hence, the metal body is required to be higher to suppress the sidelobe. Specifically, since electronic circuits such as a feed circuit, a transmitting circuit, and a receiving circuit are placed around the antenna elements, the metal body is required to be provided at a position apart from the antenna elements. As the metal body is provided at a position farther from the antenna elements, the metal body is required to be higher. Otherwise, the sidelobe cannot be suppressed.

In addition, in recent years, antenna apparatuses, which are configured by using microstrip antennas as radiation elements and using a microstrip line as a feed line are in heavy usage because the antenna apparatuses can be easily manufactured at low cost.

However, in the antenna apparatuses configured by the microstrip antennas and the microstrip line, undesired radiation components generated from the feed line causes sidelobe to increase, which is one reason for degrading antenna directivity.

However, the conventional apparatuses, which control, focusing on the radiation components generated from the radiation element, the radiation element, have a problem that the above described influence of the undesired radiation cannot be suppressed.

Solution to Problem

One embodiment realizes a thin and small antenna apparatus in which the height of a member suppressing sidelobes is lowered as much as possible with respect to a substrate on which antenna elements are arranged, even at a position apart from the antenna elements, to effectively suppress the sidelobes to be reduced.

In addition, one embodiment suppresses influence of undesired radiation components in the antenna apparatus to improve the characteristics of the antenna apparatus.

An antenna apparatus of one embodiment has a dielectric substrate and conductors. The antenna apparatus includes: an antenna element which is arranged on a main surface of the dielectric substrate and has directivity ahead of the main surface, and a directional characteristic control member which includes a sidewall part which projects ahead of the main surface on at least one side of directivity of the antenna element with respect to the antenna element, and a roof part which projects in a direction of the antenna element from the sidewall part at a predetermined angle of more than 70° and less than 120° with respect to the sidewall part so that orthogonal projection to the main surface does not reach the antenna element, to reflect or absorb radio waves.

DESCRIPTION OF EMBODIMENTS

Hereinafter, embodiments of the present invention are described with reference to the drawings. Note that the present invention is not limited to the following embodiments.

(First Embodiment)

Figure 1:
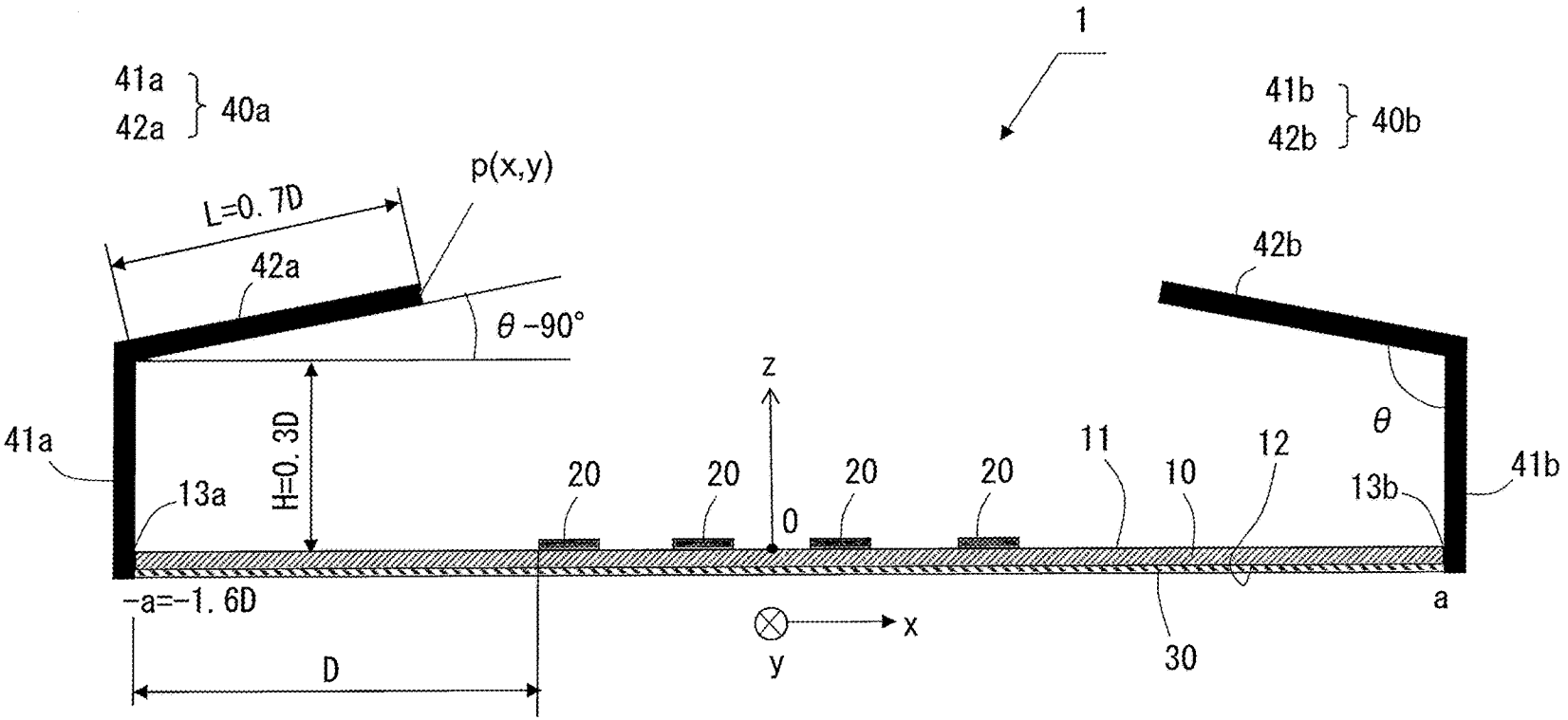
FIG. 1 is a sectional view showing a configuration of an antenna apparatus according to a first embodiment.
Figure 2:
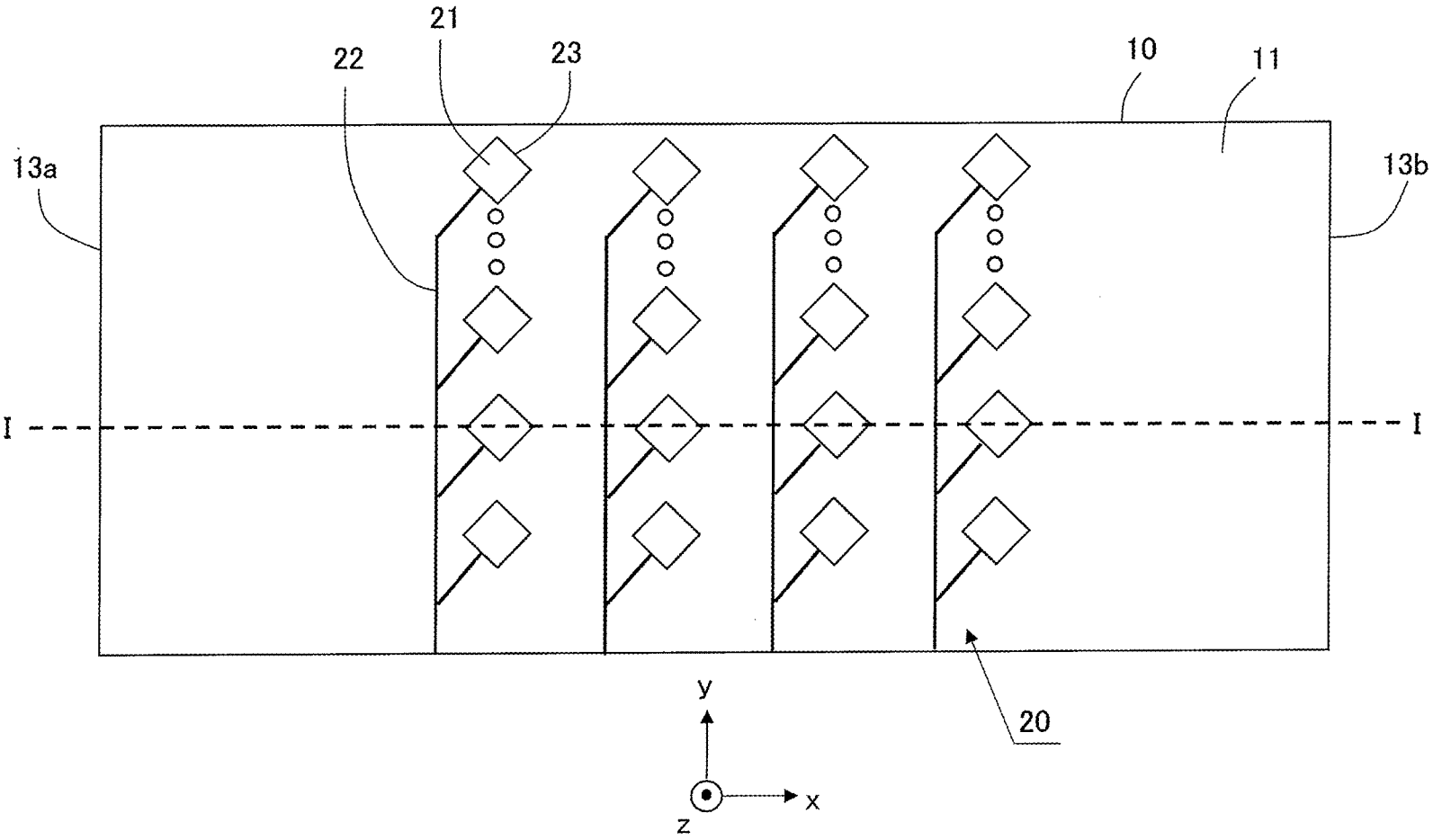
FIG. 2 is a plan view showing the configuration of the antenna apparatus according to the first embodiment.

FIG. 1 and FIG. 2 show a configuration of an antenna 1 according to an embodiment. A dielectric substrate 10 having a rectangular parallelepiped sheet shape has a first face 11, which is a main face (front surface), and a second face 12, which is a rear surface of the dielectric substrate 10 and is parallel to the first face 11. The z axis is perpendicular to the first face 11. The x axis is parallel to the long side of the dielectric substrate 10. The y axis is perpendicular to the x axis and is parallel to the short side of the dielectric substrate 10. On the first face 11, antenna elements 20 are provided which are formed of a thin-film conductor which is an array of patch antennas 21 each having a rectangular shape. As shown in FIG. 2, the patch antenna 21 has a rectangular shape. A radiation side 23, which radiates electromagnetic waves of the patch antennas 21 or receives waves, is inclined at an angle of −45° with respect to the xz plane. If the dielectric substrate 10 is placed in a vehicle or the like so that the z axis is parallel to a horizontal plane, the xz plane becomes the horizontal plane.

The plurality of patch antennas 21 are connected to one side of an electric supply line 22 extending in the y axis direction. These plurality of one-dimensional arrays extending in the y axis direction are arranged in the x axis direction to configure an array of the antenna elements 20. Hence, the antenna 1 has directional characteristics on the xz plane. The antenna 1 can radiate electromagnetic waves whose polarization direction is inclined at an angle of 45° with respect to the horizontal plane, and can receive waves. If the antenna 1 is installed on a vehicle or the like so that the z axis has a predetermined angle of elevation with respect to the horizontal plane, the antenna 1 has predetermined directional characteristics on a plane having a predetermined angle of elevation with respect to the horizontal plane.

In addition, on the whole of the second face 12, a ground layer 30 is formed which is formed of thin-film conductors having a rectangular face shape. The electric supply line 22 and the ground layer 30 are connected to an external signal source (abbreviate in the figures). The antenna elements 20 and the ground layer 30 configure a patch array antenna. Receiving a signal provided from the signal source, the patch array antenna radiates electromagnetic waves into the space. Note that when the antenna 1 is a receiving antenna, the signal source is an external receiving circuit (abbreviate in the figures).

In addition, sidewall parts 41*a*, 41*b* formed of metal bodies are provided so as to contact side surfaces of both short sides 13*a*, 13*b* of the dielectric substrate 10, respectively. The sidewall parts 41*a*, 41*b* are electrically connected to the ground layer 30. In addition, roof parts 42*a*, 42*b* are formed by being bent so as to be continued from the sidewall parts 41*a*, 41*b*. The roof parts 42*a*, 42*b* are formed of metal bodies projecting toward the antenna elements 20. The angles θ between the roof parts 42*a*, 42*b* and the sidewall parts 41*a*, 41*b* are 110° The sidewall part 41*a* and the roof part 42*a* configure a directional characteristic control member 40*a*. The sidewall part 41*b* and the roof part 42*b* configure a directional characteristic control member 40*b*. Note that the sidewall parts 41*a*, 41*b* and the roof parts 42*a*, 42*b* may be one continuous piece or connected separate bodies. In addition, the sidewall parts 41*a*, 41*b* and the roof parts 42*a*, 42*b* may be formed of a conductor or may be formed by forming a metal coating on a surface of a resin.

In FIG. 1, the distance between the sidewall part 41*a* and the antenna element 20 closest to the sidewall part 41*a* is defined as D. The distance a from the origin o to the antenna elements 20 is 1.6D. The height H is 0.3D, and the length L of the roof part 42*a* is 0.7D. The directional characteristic control member 40*b* is also similar.

Figure 3:
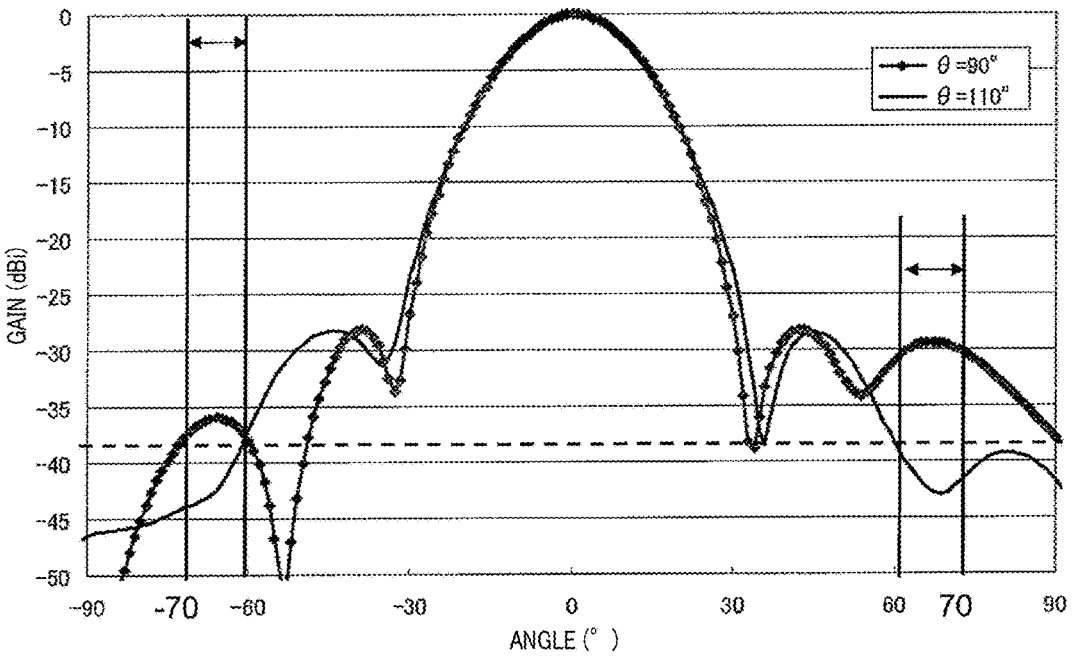
FIG. 3 is a diagram showing directional characteristics of the antenna apparatus according to the first embodiment.

In this configuration, directional characteristics on the xz plane are determined by simulation. FIG. 3 shows the result. The horizontal axis indicates angles with respect to the z axis (principal axis of directional characteristics), that is, incident angles or radiation angles of electromagnetic waves on the xz plane. The directional characteristics are not bilaterally symmetric, because the patch antennas 21 is inclined at an angle of −45°, and polarization vector of the electromagnetic wave and the xz plane cross each other at an angle of −45°.

A simulation is performed on condition that the angle θ between the sidewall part 41 and the roof part 42 is 90° or 110°. It can be clearly seen that the secondary sidelobes between −60° and −70° and between 60° and 70° are significantly suppressed in a case where θ is 110°. In the range between −60° and −70°, it can be seen that, in a case where θ is 110°, the level is lowered by 7 dB compared with a case where θ is 90°. In the range between 60° and 70° at the right side, it can be seen that, in a case where θ is 110°, the level is lowered by 14 dB compared with a case where θ is 90°.

Note that when using the antenna apparatus of the present embodiment as a millimeter wave radar, in angular intervals between −60° and −70° and between 60° and 70°, sidelobes which are required to be suppressed are generated to decrease erroneous detection due to grating.

Figure 4:
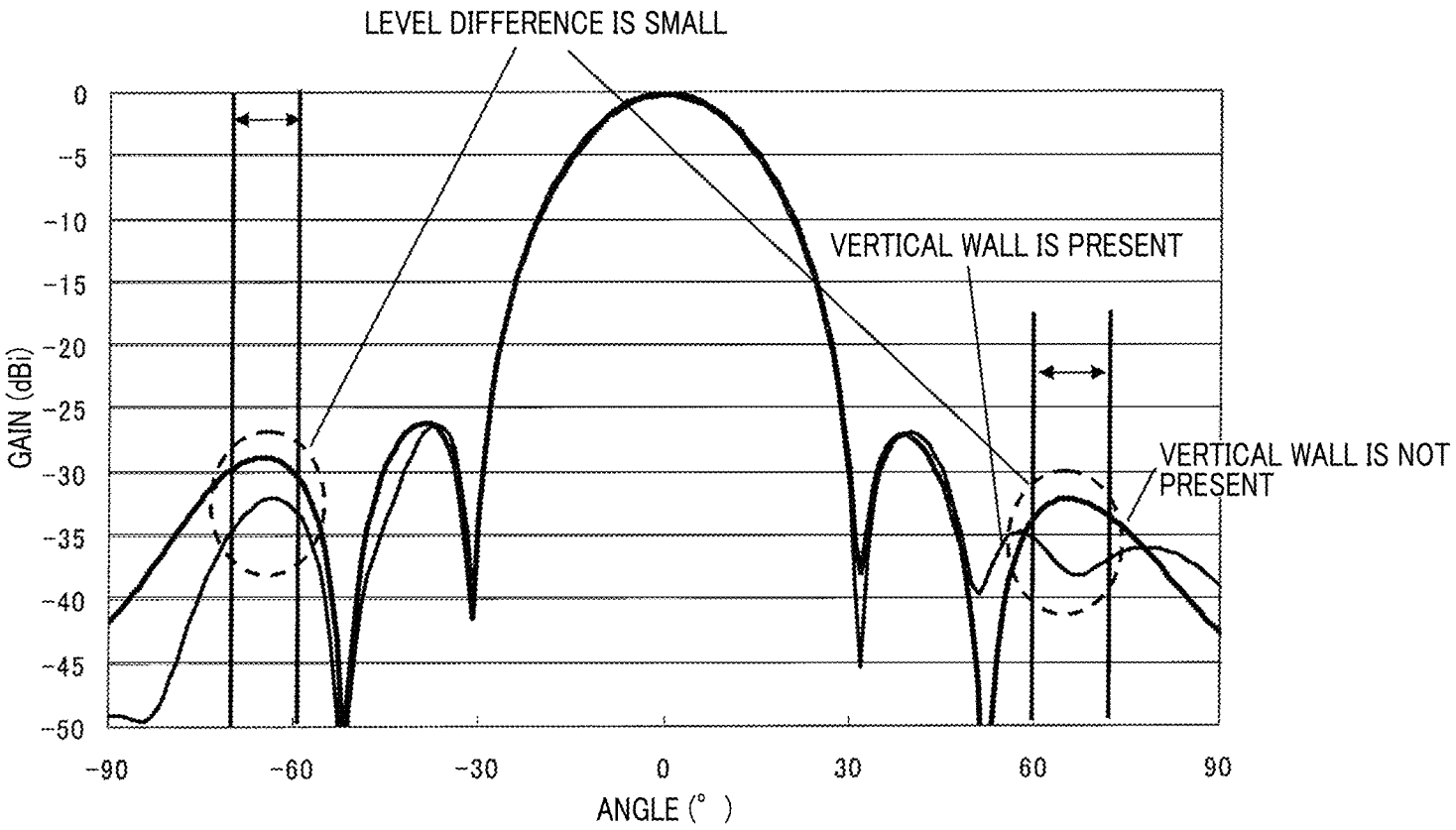
FIG. 4 is a diagram showing directional characteristics of a conventional antenna apparatus.
Figure 5:
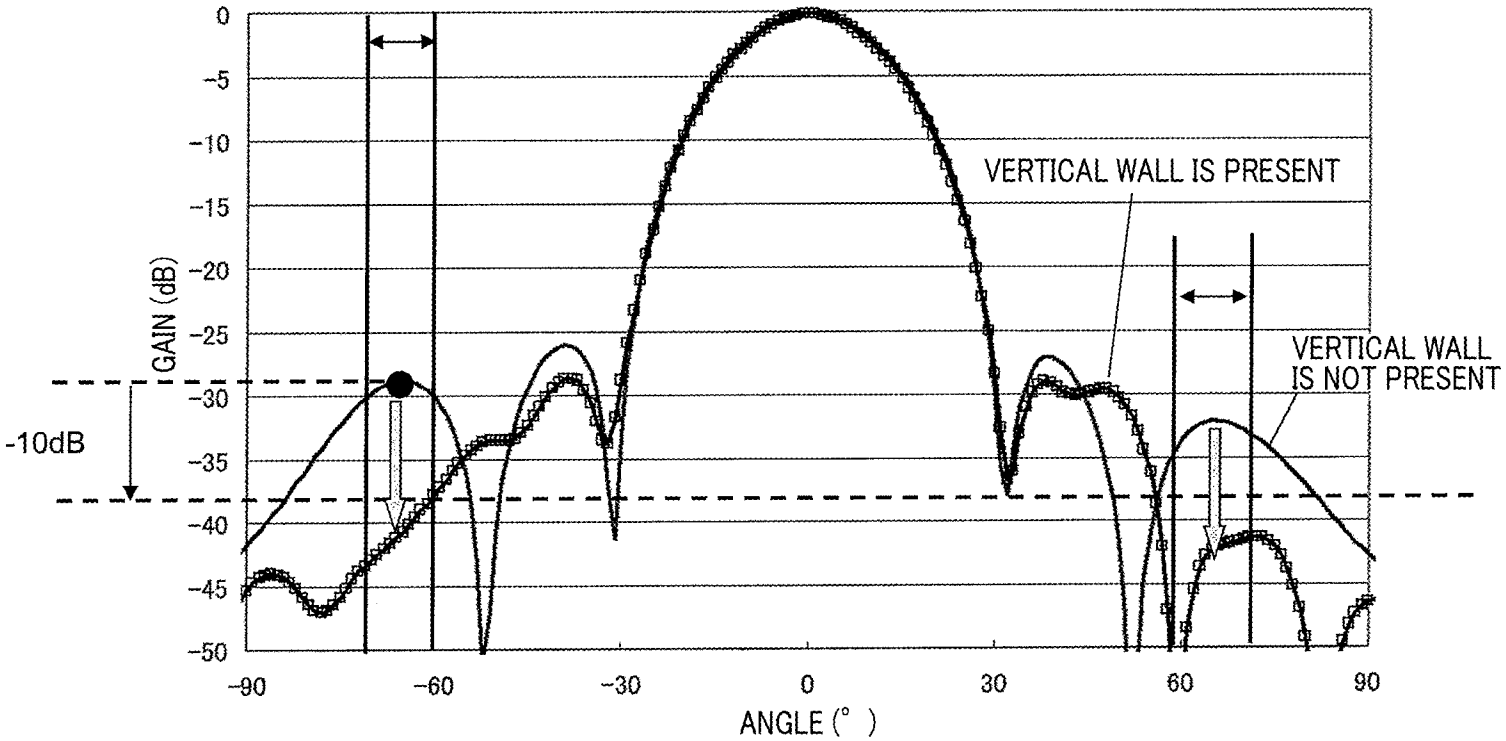
FIG. 5 is a diagram showing directional characteristics of a conventional antenna apparatus.

For comparison, in the configuration shown in FIG. 1, directional characteristics are simulated for a case where the roof parts 42*a*, 42*b* are not provided but only the sidewall parts 41*a*, 41*b* are provided. FIG. 4 shows a case where the height H of the sidewall parts is 0.5H. FIG. 5 shows a case where the height H is D. In each case, directional characteristics obtained in a case where the sidewall parts are not provided are also shown. In the case where the height H of the sidewall parts is 0.5D, compared with the case where the sidewall parts are not provided, the secondary sidelobes are suppressed by up to only about 4 dB between −60° and −70° and by up to only about 6 dB between 60° and 70°. In addition, in the case where the height H of the sidewall parts is D, it can be seen that the secondary sidelobes are suppressed by equal to or more than 10 dB, compared with the case where the sidewall parts are not provided.

In addition, compared with the directional characteristics where θ is 110° in the present embodiment shown in FIG. 3, it can be seen that, when θ is 110°, a suppression effect can be provided which is similar to that provided in the case where the height H of the sidewall parts is D between −60° and −70° at the left side. Note that the secondary sidelobes of the directional characteristics are not necessarily required to be suppressed at the both of the positive and negative sides. In many cases, radiation angles or incident angles of electromagnetic waves are used at only one side. In this case, the directional characteristic control member 40 may be provided at only the side where the level of the secondary sidelobes is higher. According to the present embodiment, it can be understood that since the roof parts, which form an angle of 110° with the sidewall parts, are provided, the height H of the sidewall parts can be decreased by 3/10 with respect to the height of the sidewall parts obtained when the roof parts are not provided, to provide the similar effect of suppressing the sidelobes.

Figure 6A:
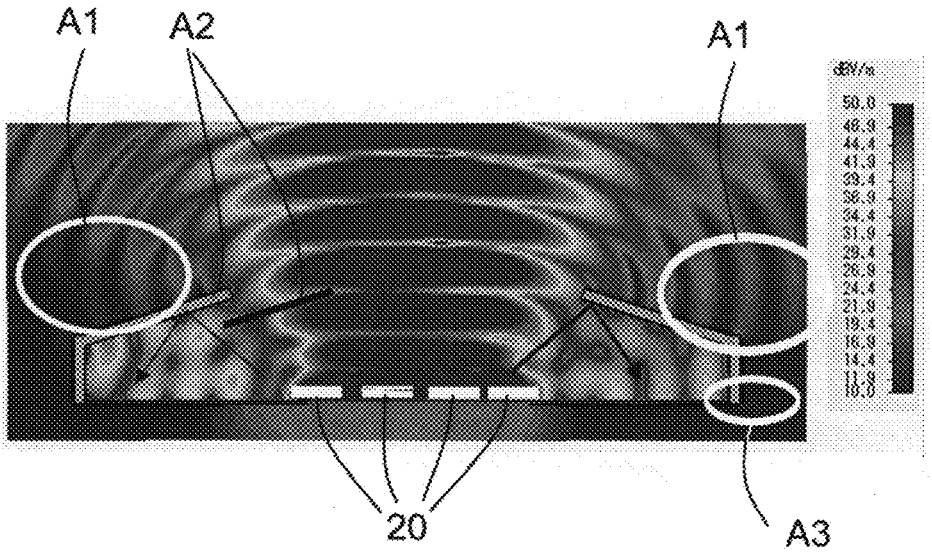
FIG. 6A is a characteristic diagram showing an electric field distribution of the antenna apparatus according to the first embodiment.
Figure 6B:
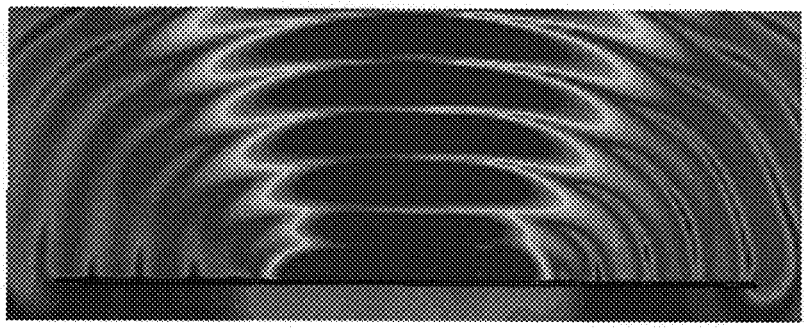
FIG. 6B is a characteristic diagram showing an electric field distribution of the conventional antenna apparatus.

FIG. 6A shows an electric field distribution of electromagnetic waves of the antenna 1 according to the present embodiment. FIG. 6B shows an electric field distribution of electromagnetic waves of the antenna having no directional characteristic control member. It can be seen that since the directional characteristic control member is grounded, the electric field is extremely small outside the sidewall part 41, and wave fronts are formed in the inclination direction of the roof part 42 in the vicinity of the end of the roof part 42. In addition, in an area A1 outside the roof part 42, electromagnetic waves are reflected from the roof part 42, thereby lowering the level of the sidelobes in the direction of the roof part 42.

In addition, it can be understood that also in a case where θ is set to 108° and 112°, which is obtained by adding ±2 to 110°, the similar effect can be obtained by simulation. Hence, the angle θ between the sidewall part 41 and the roof part 42 is desirably 108° or more, or 112° or less.

(Second Embodiment)

Figure 7:
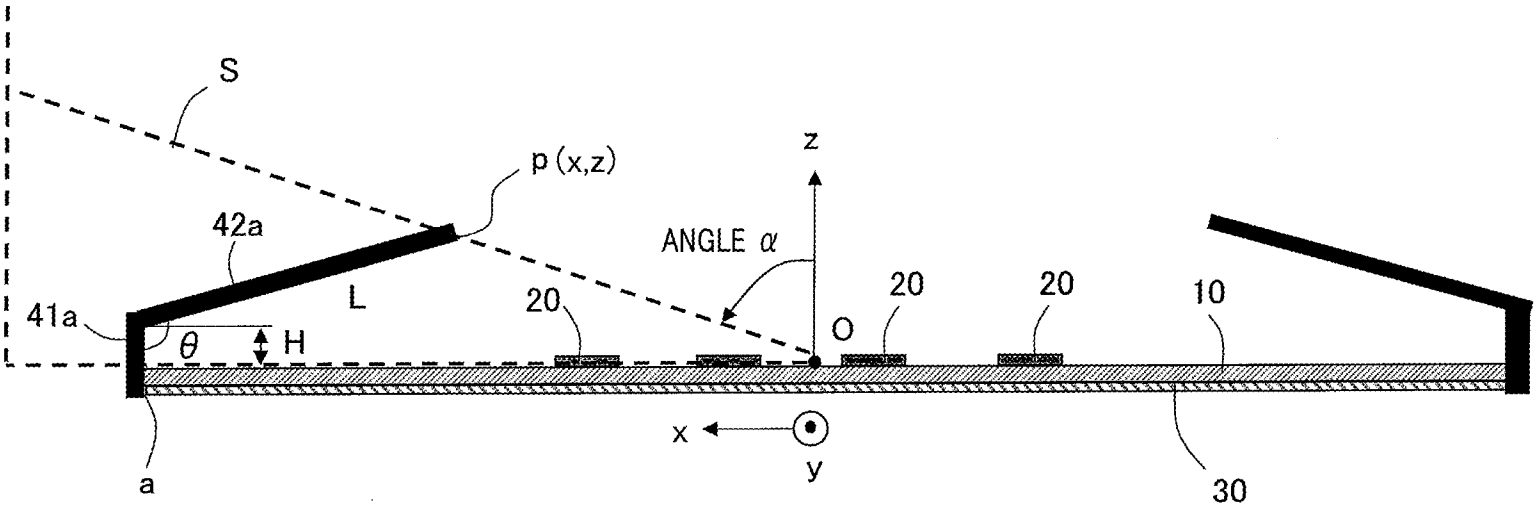
FIG. 7 is an explanatory drawing showing a straight line on which an end point of a roof part of the antenna apparatus exists according to a second embodiment.

The second embodiment considers the relationship between the height H of the sidewall part 41 and the length L of the roof part 42. As shown in FIG. 7, a straight line S is considered which connects between the origin o of the antenna elements 20 which is the origin of the principal axis (z axis) of directional characteristics and a coordinate (x, z) of an end p near the dielectric substrate 10 (inside).

The angle α between the straight line S and the z axis is the maximum angle required for suppressing the secondary sidelobes of the directional characteristics. For example, α is 60°. The equation expressing the straight line S is the following expression.

[Expression 1]

$$z = x\cot(\alpha) \tag{1}$$

In addition, the x-coordinate of the sidewall part 41 is defined as a. The following expression is established.

[Expression 2]

$$z = H + L\cos(\theta) \tag{2}$$

[Expression 3]

$$x = a - L\sin(\theta) \tag{3}$$

Since the p point (x, z) is on the straight line S of the expression (1), the following expression is established.

[Expression 4]

$$H + L\cos(\theta) = [a - L\sin(\theta)]\cot(\alpha) \tag{4}$$

[Expression 5]

$$H + L = \frac{a\cot(\alpha)}{\cos(\theta) + \sin(\theta)\cot(\alpha)} \tag{5}$$

That is, the relationship between the height H of the sidewall part 41 and the length L of the roof part 42 satisfies expression (5).

The combination of the height H of the sidewall part 41 and the length L of the roof part 42 reduces the secondary sidelobes.

Figure 8:
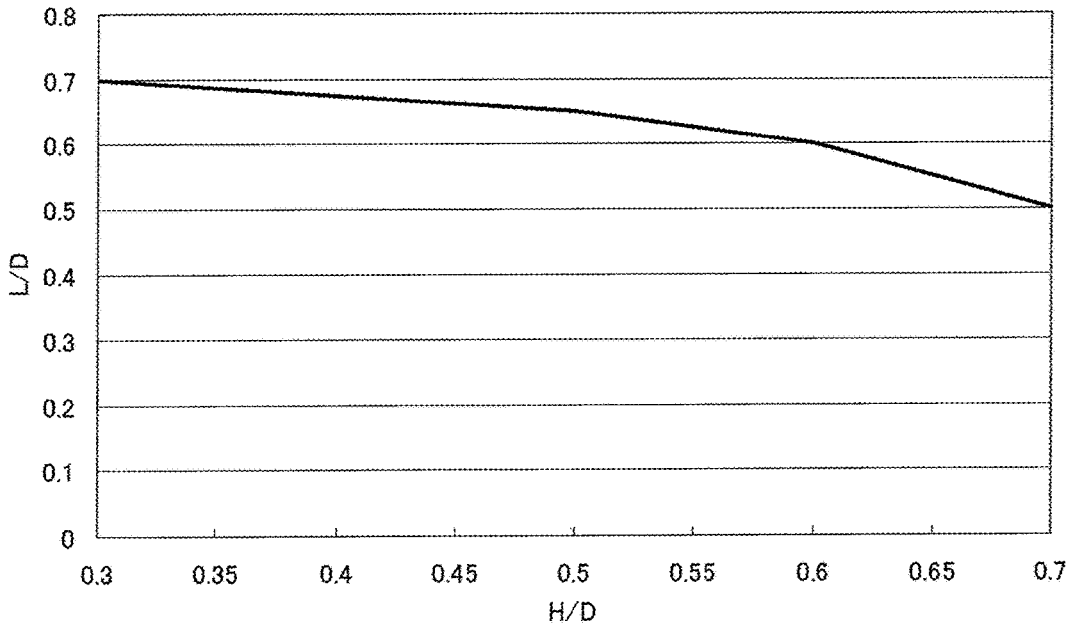
FIG. 8 is a characteristic diagram showing a relationship between the height of a sidewall part and the length of a roof part of the antenna apparatus according to the second embodiment.

FIG. 8 shows a relationship of (H, L) obtained by simulation when the secondary sidelobes become −42 dB or less where θ=110°, α=60°, and a=1.6D. In the range where H is 0.6D or more and 0.7D or less, L+H=1.2D is established which satisfies the expression (5). However, as a ratio H/D of the height of the sidewall part 41 to the distance D is smaller, the expression (5) becomes further from being satisfied. When H=0.3.D, L+H=D is established. This means that as the ratio H/D of the height of the sidewall part 41 to the distance D is smaller, the length L of the roof part 42 is allowed to be further shorter than the length of the roof part 42 determined by the straight line expressed by the expression (5). That is, this means that as the end point p of the roof part 42 is closer to the origin o, the angle α for suppressing the secondary sidelobes can be larger. In other words, it can be understood that closer to the dielectric substrate 10, the effect of the roof part 42 becomes larger. In this sense, the height H of the sidewall part is desirably 0.3D or more and 0.5D or less.

As described above, according to the present embodiment, the secondary sidelobes can be effectively suppressed. For an array antenna, according to a typical method of suppressing the sidelobes, a distribution such as Chebyshev is applied to a feeding distribution of each element of the array. However, according to the method of controlling the feeding distribution, realizable suppression of the sidelobes is limited to about −30 dB for the level (peak) in the principal axis direction under constraints on producing line widths of feeding lines. In contrast, according to the present embodiment, the secondary sidelobes are suppressed −36 dB or more when θ=90°, and −38 dB or more when θ=110°, with respect to the level in the principal axis direction.

(Third Embodiment)

Figure 9A:
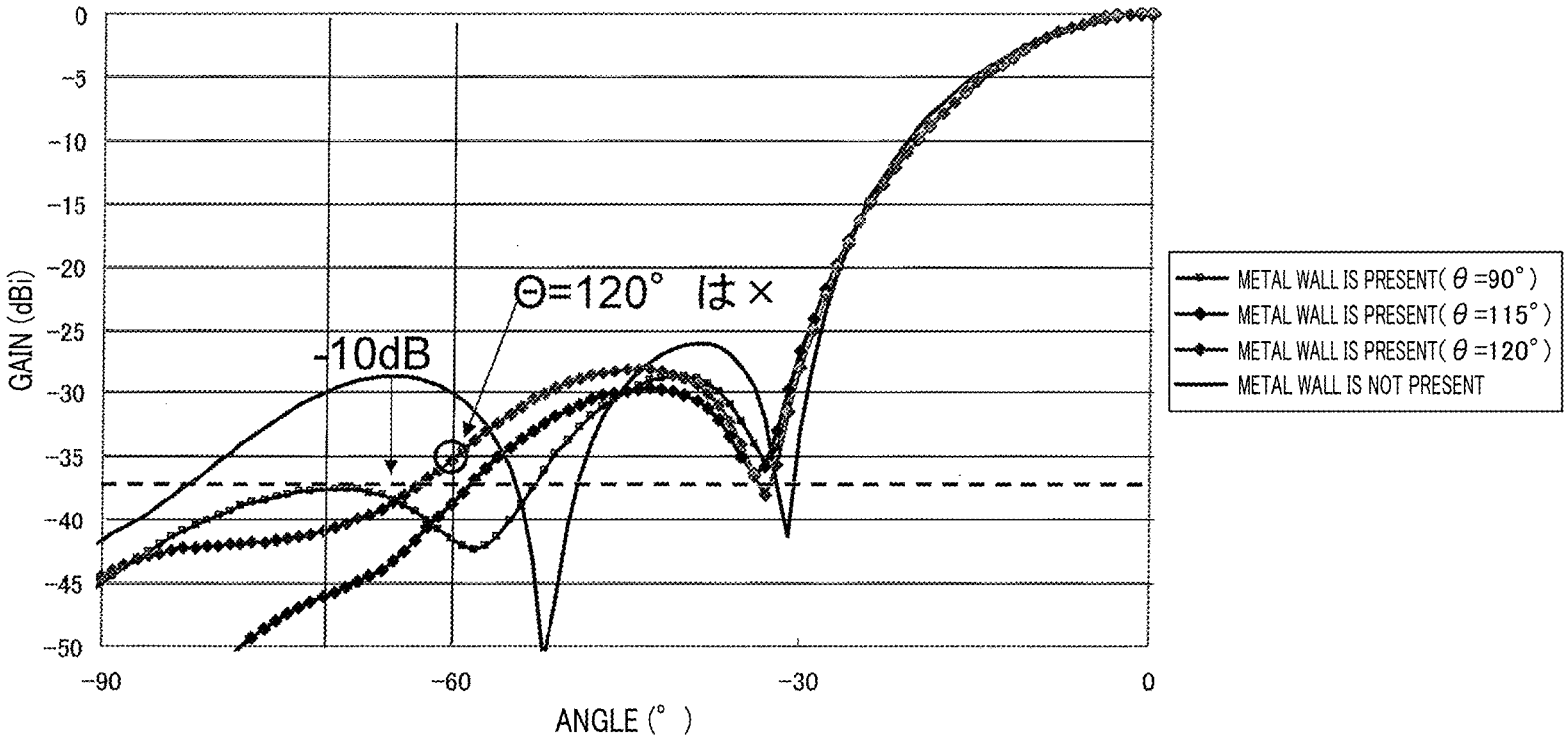
FIG. 9A is a diagram showing directional characteristics of the antenna apparatus according to a third embodiment.
Figure 9B:
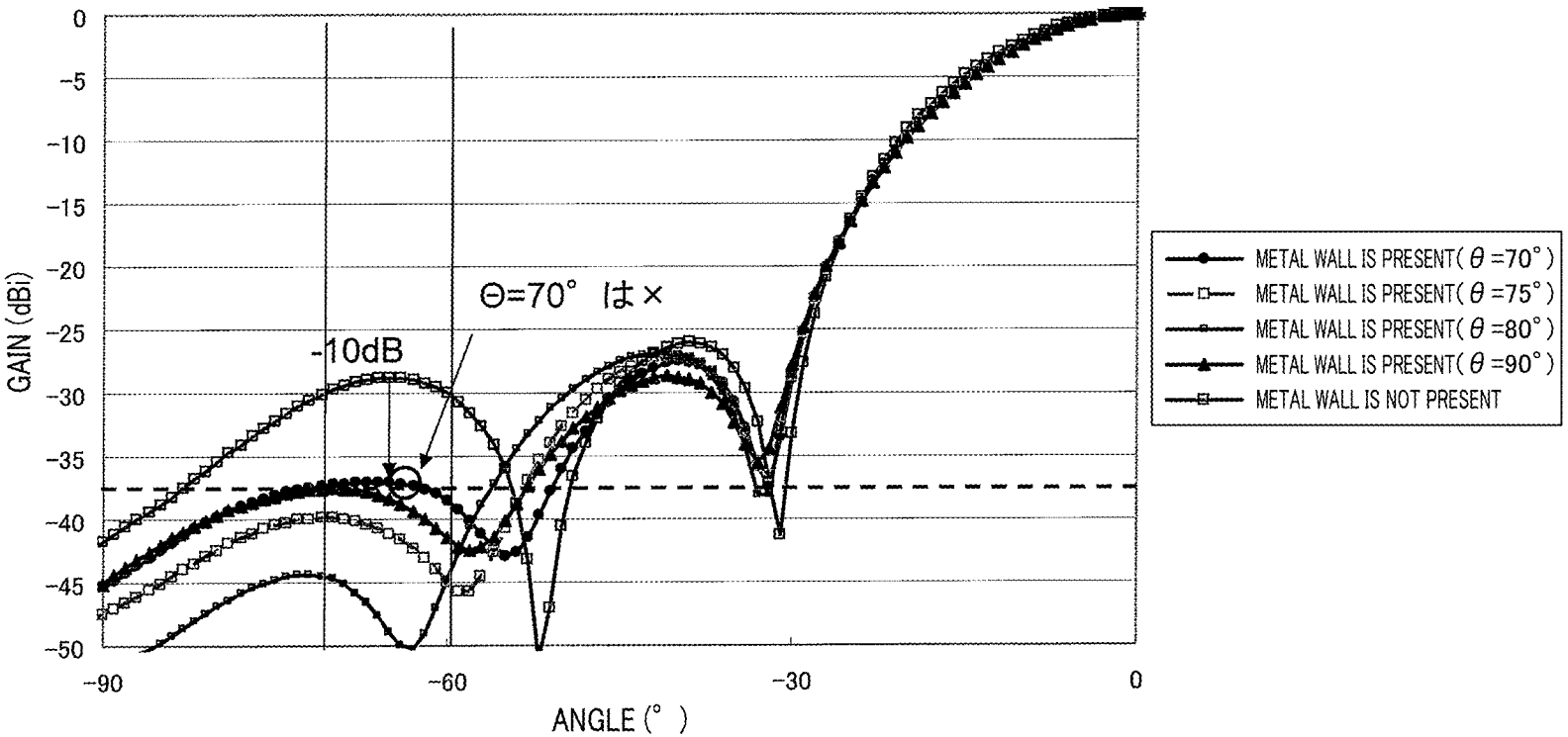
FIG. 9B is a diagram showing directional characteristics of the antenna apparatus according to the third embodiment.
Figure 10:
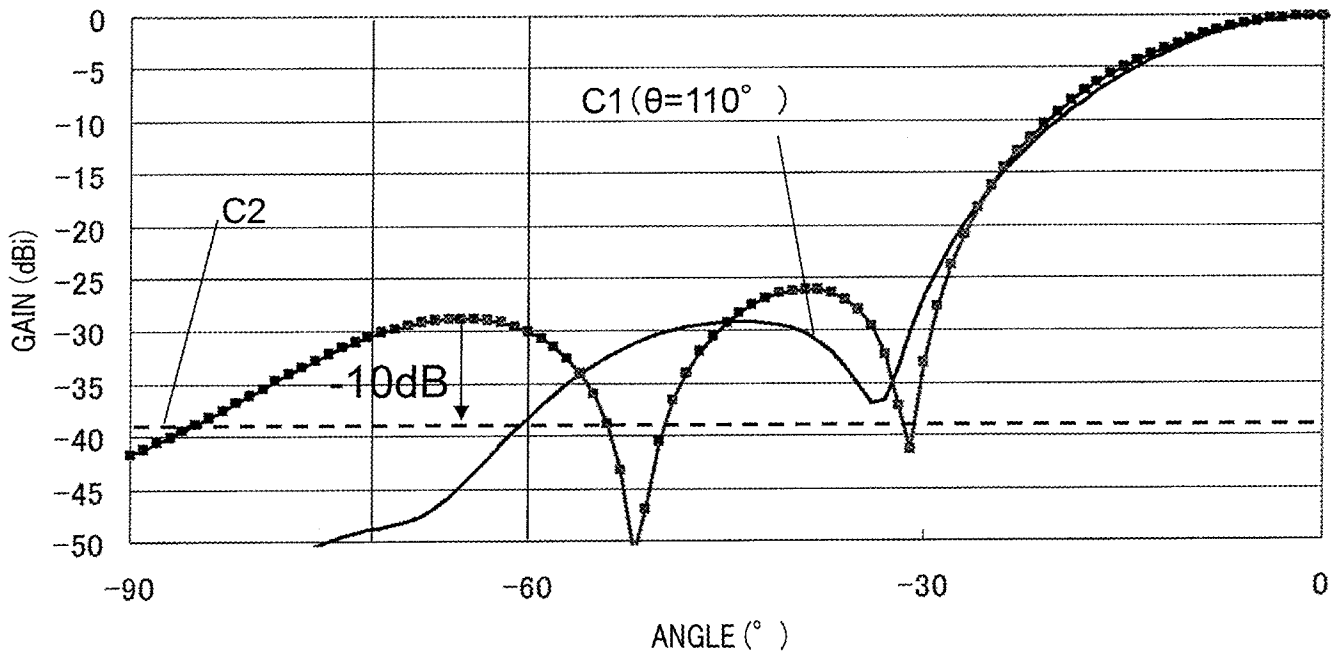
FIG. 10 is a diagram showing directional characteristics of the antenna apparatus according to the third embodiment.

Next, in the third embodiment, a simulation of directional characteristics is performed by changing the angle θ between the sidewall part 41*a* and the roof part 42*a* in the order of 70°, 75°, 80°, 90°, 110°, 115°, and 120°. The results are shown in FIGS. 9A, 9B, and 10. Note that the simulation is performed in which the sidewall part 41*a* and the roof part

42*a* are provided at only one side of the dielectric substrate 10, the one side being required to suppress the secondary sidelobes. When defining the distance between the sidewall part 41*a* and the antenna element closest to the sidewall part 41*a* as D, the height H of the sidewall part 41*a* is 0.3D, and the length L of the roof part 42*a* is 0.7D. The distance a between the root part of the sidewall part 41*a* and the origin o is 1.6D.

When θ is 75°, 80°, 90°, 110°, 115°, the level of the secondary sidelobes is −38 dB or less with respect to the peak level in the principal axis direction. However, it can be understood that, when θ is 70° or 120°, the level of the secondary sidelobes is −35 dB or less, but portions exceeding −38 dB exist, whereby the secondary sidelobes are not sufficiently suppressed. Accordingly, θ is desirably 75° or more and 115° or less.

(Fourth Embodiment)

Figure 11:
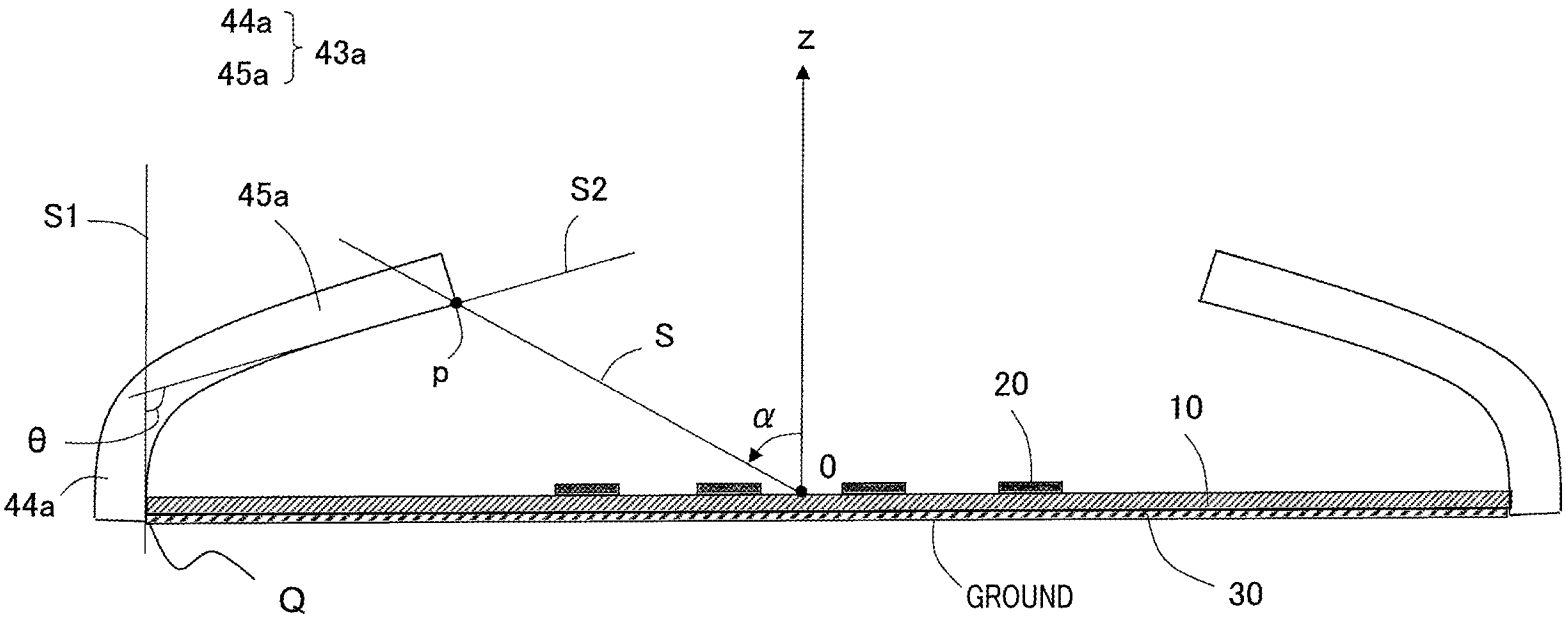
FIG. 11 is a sectional view showing a configuration of an antenna apparatus according to a fourth embodiment.

FIG. 11 shows a configuration of an antenna apparatus according to the fourth embodiment. As shown in FIG. 11, a directional characteristic control member 43 consisting of a sidewall part 44*a* and a roof part 45*a* may be configured in a curved shape. In this case, the angle θ between the sidewall part 44*a* and the roof part 45*a* is defined by an angle between a tangential line S1 at the lowest point Q inside the connecting part between the sidewall part 44*a* and the dielectric substrate 10 and a tangential line S2 at the inside extreme end p of the roof part 45*a*. In addition, the end p of the roof part 45*a* is defined as a point on the straight line S, the angle α between the straight line S and the z axis passing through the origin o of the array antenna being 60°.

(Fifth Embodiment)

Figure 12:
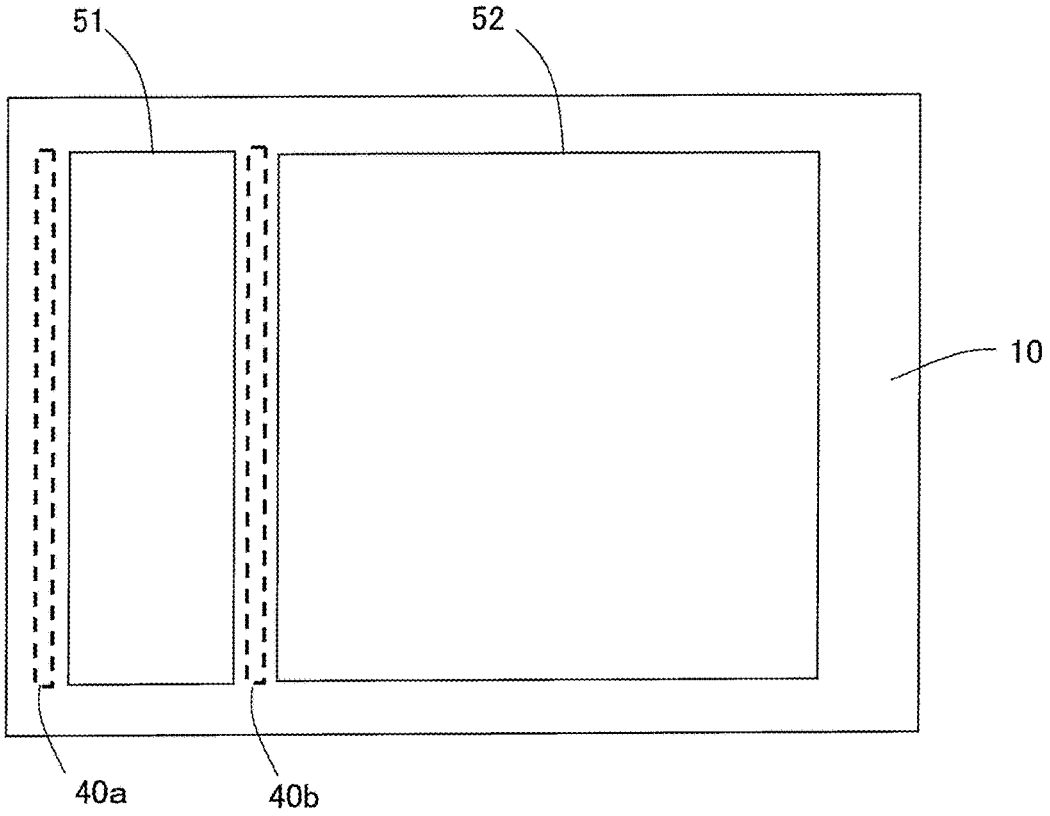
FIG. 12 is a block diagram of an antenna apparatus according to a fifth embodiment.

FIG. 12 shows a configuration of an antenna apparatus according to the fifth embodiment. The antenna 1 of the present embodiment is a radar in which a transmitting array antenna 51 and a receiving array antenna 52 are provided on the same dielectric substrate 10. The antenna 1 is configured by providing the directional characteristic control members 40*a*, 40*b*, which have a configuration shown in FIG. 1, at the both sides of the transmitting array antenna 51. In this case, the directional characteristic control member may be provided at only the side which is required for suppressing the secondary sidelobes of one side of the directional characteristics.

(Sixth Embodiment)

Figure 13:
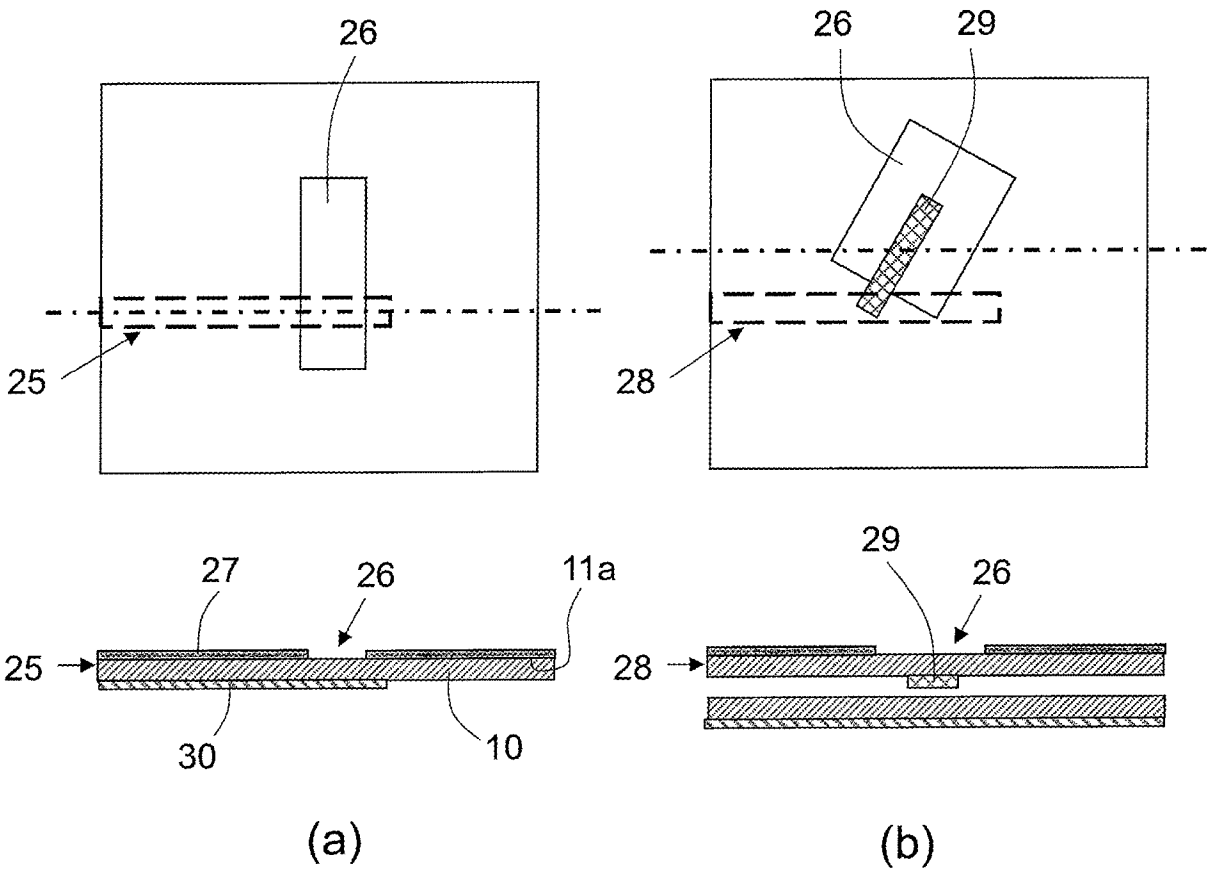
FIG. 13 is a block diagram of an antenna element included in an antenna apparatus according to a sixth embodiment.

FIG. 13 shows a configuration of the antenna element 20 according to the sixth embodiment. As shown in FIG. 13(*a*), a feeding line 25 can be formed by the ground layer 30, which is provided on the rear surface of the dielectric substrate 10, and microstrip lines 27 formed on a main surface 11*a*, and a slot array antenna can be configured by providing slots 26 provided by cutting out a plurality of portions of the microstrip line 27. The slot array antenna can be the antenna element 20 of all the above embodiments. In addition, as shown in FIG. 13(*b*), the antenna, which is formed as an array by providing a number of combinations of the slot 26 and the dipole 29 to a triplate line 28, can be used as the antenna element 20 of all the above embodiments.

(Seventh Embodiment)

<Configuration>

Figure 14:
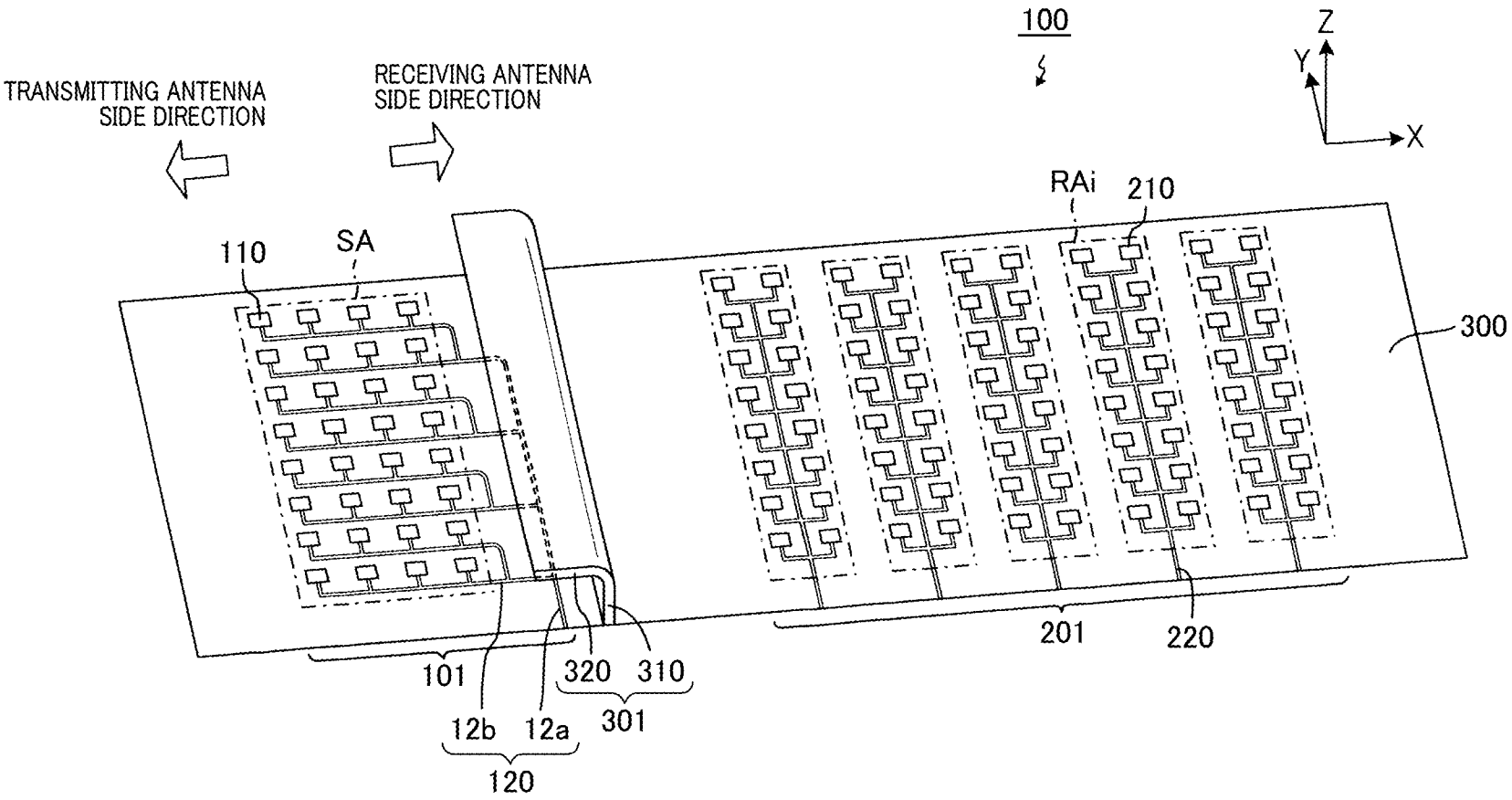
FIG. 14 is a diagram showing a general configuration of an antenna apparatus according to a seventh embodiment.

An antenna apparatus 100 is used as an antenna of an in-vehicle radar, and as shown in FIG. 14, includes a transmitting antenna section 101, a receiving antenna section 201, and a shielding section 301. Each of the sections is formed on one surface (front surface) of a rectangular dielectric substrate 300. Note that ground patterns (not shown) are formed on the whole other surface (rear surface) of the rectangular dielectric substrate 300. Hereinafter, the longitudinal direction of the dielectric substrate 300, the widthwise direction of the dielectric substrate 300, and the direction orthogonal to the surface of the dielectric substrate 300 are also referred to as an X axis direction, a Y axis direction, and a Z axis direction, respectively.

The transmitting antenna section 101 is configured by a radiation element group SA including a plurality of radiation elements 110 two-dimensionally arranged in the X axis direction and the Y axis direction, and a feed line 120 which supplies electricity to each of the radiation elements 110 configuring the radiation element group SA. The feed line 120 includes a main line 12*a* and branch lines 12*b*. The main line 12*a* is wired on the receiving antenna section 201 side with respect to a portion where the radiation element group SA is formed, and along an outer edge (Y axis direction) of the portion where the radiation element group SA is formed. The branch lines 12*b* are wired, for each of rows of the radiation elements 110 along the X direction, along the rows of the radiation elements 110. Ends of the branch lines 12*b* are connected to the main line 12*a*. Each of the radiation elements 110 configuring the row of the radiation elements is connected to the branch line 12*b* corresponding to the row of the radiation elements via an individual line.

The receiving antenna section 201 is consisted of n (n is two or more) unit antennas RAi (i=1 to n) arranged along the X axis direction. Each of the unit antennas RAi has a similar configuration, and is configured by a plurality of radiation elements 210 having a rectangular shape, and a feed line 220 supplying electricity to each of the radiation elements 210. The radiation elements 210 are arranged in two rows and along the Y axis. The feed line 220 is wired between the two rows of the radiation elements. The radiation elements 210 are connected to the feed line 220 via the individual lines.

Note that each of the radiation elements 110, 210 and each of the feed lines (including individual lines) 120, 220 configuring the transmitting antenna section 101 and the receiving antenna section 201 configure a microstrip antenna and a microstrip line in cooperation with the ground patterns on the rear surface of the dielectric substrate 300.

Figure 15:
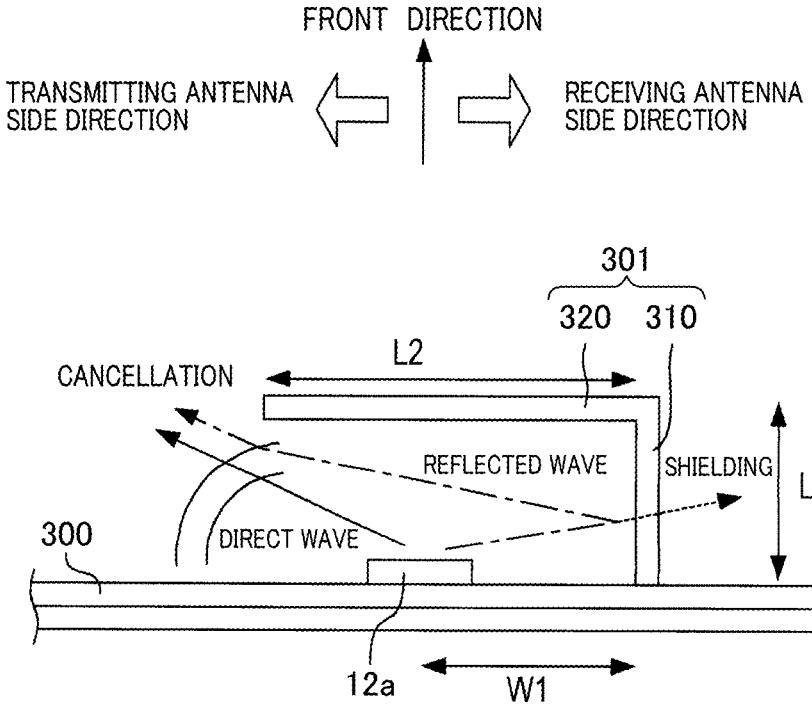
FIG. 15 is a diagram showing a configuration and effects of a shielding part.

The shielding section 301 is formed of a metal plate whose cross section has an L shape. As shown in FIG. 15, the shielding section 301 includes a sidewall part 310 which stands on the receiving antenna section 201 side with respect to the main line 12*a* and an upper wall part 320 which projects above the main line 12*a* from the end of the sidewall part 310, along the main line 12*a* of the feed line 120 configuring the transmitting antenna section 101. Hereinafter, the main line 12*a* of the feed line 120 is also referred to as an undesired radiation source 12*a*.

<Advantages>

According to the antenna apparatus 100 configured as described above, undesired radiation components radiated from the undesired radiation source 12*a* in the receiving antenna side direction in which the receiving antenna section 201 is formed (right hand direction in FIG. 15) are shielded by the shielding section 301 so as to be suppressed. In addition, undesired radiation components radiated from the undesired radiation source 12*a* in the transmitting antenna side direction in which the radiation element group SA of the transmitting antenna section 101 is formed (left hand direction in FIG. 15) are suppressed in such a manner that, as shown in FIG. 15, direct waves radiated from the undesired radiation source 12*a* and the waves reflected from the shielding section 301 are interfered with each other. Furthermore, undesired radiation components directed to the transmitting antenna side interfere with the radiation components which are radiated from the radiation element group SA and are interfered with the radiation components which are directed in the same direction as that of the undesired radiation components and form sidelobes, to suppress the strength of the sidelobes.

According to the antenna apparatus 100 described above, not only the influence of the undesired radiation from the undesired radiation source 12*a* but also sidelobes can be suppressed by using the undesired radiation. That is, characteristics of the apparatus can be improved.

<Simulation>

Figure 16:
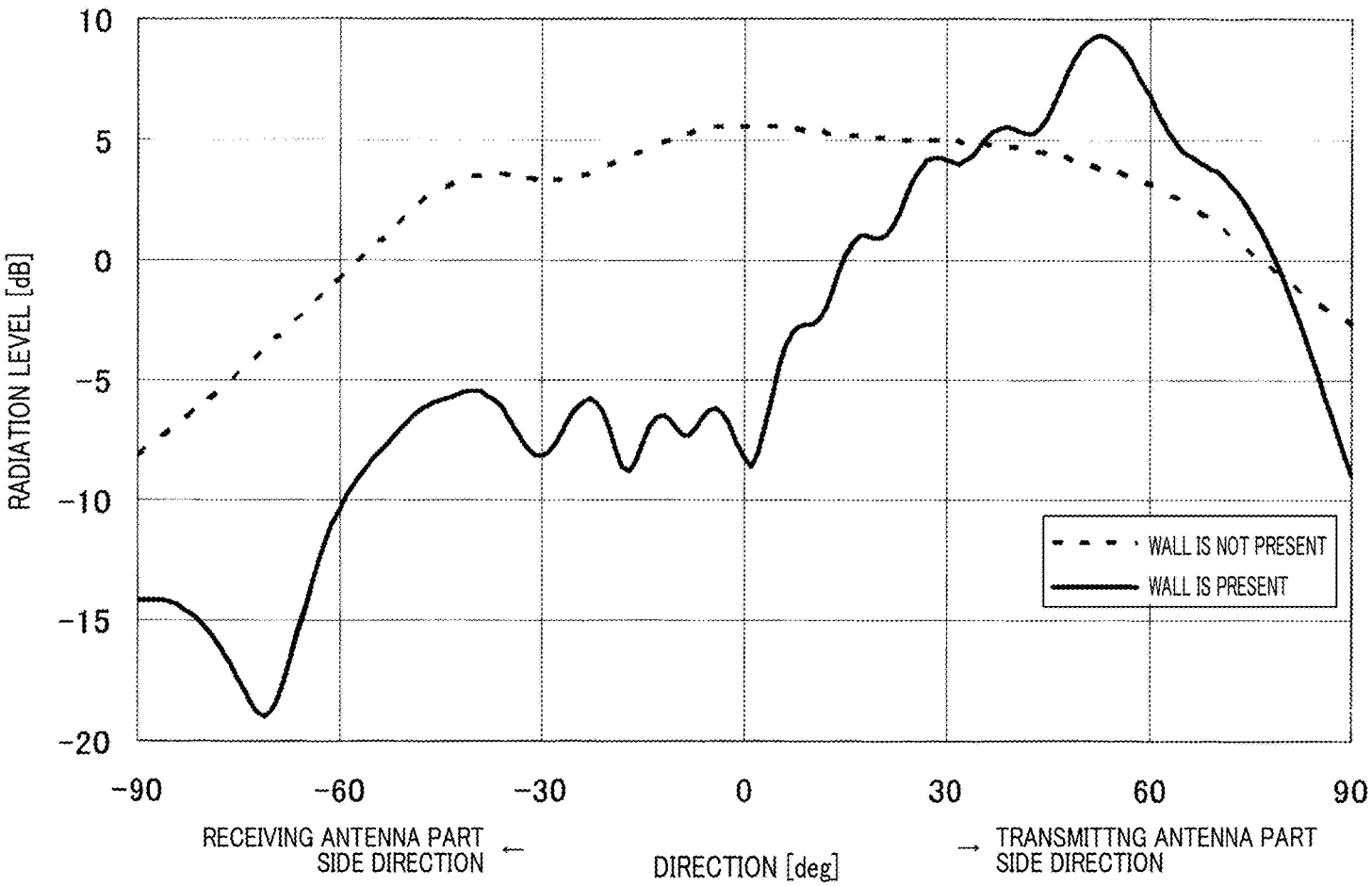
FIG. 16 is a graph showing directivity of an undesired radiation source.
Figure 17:
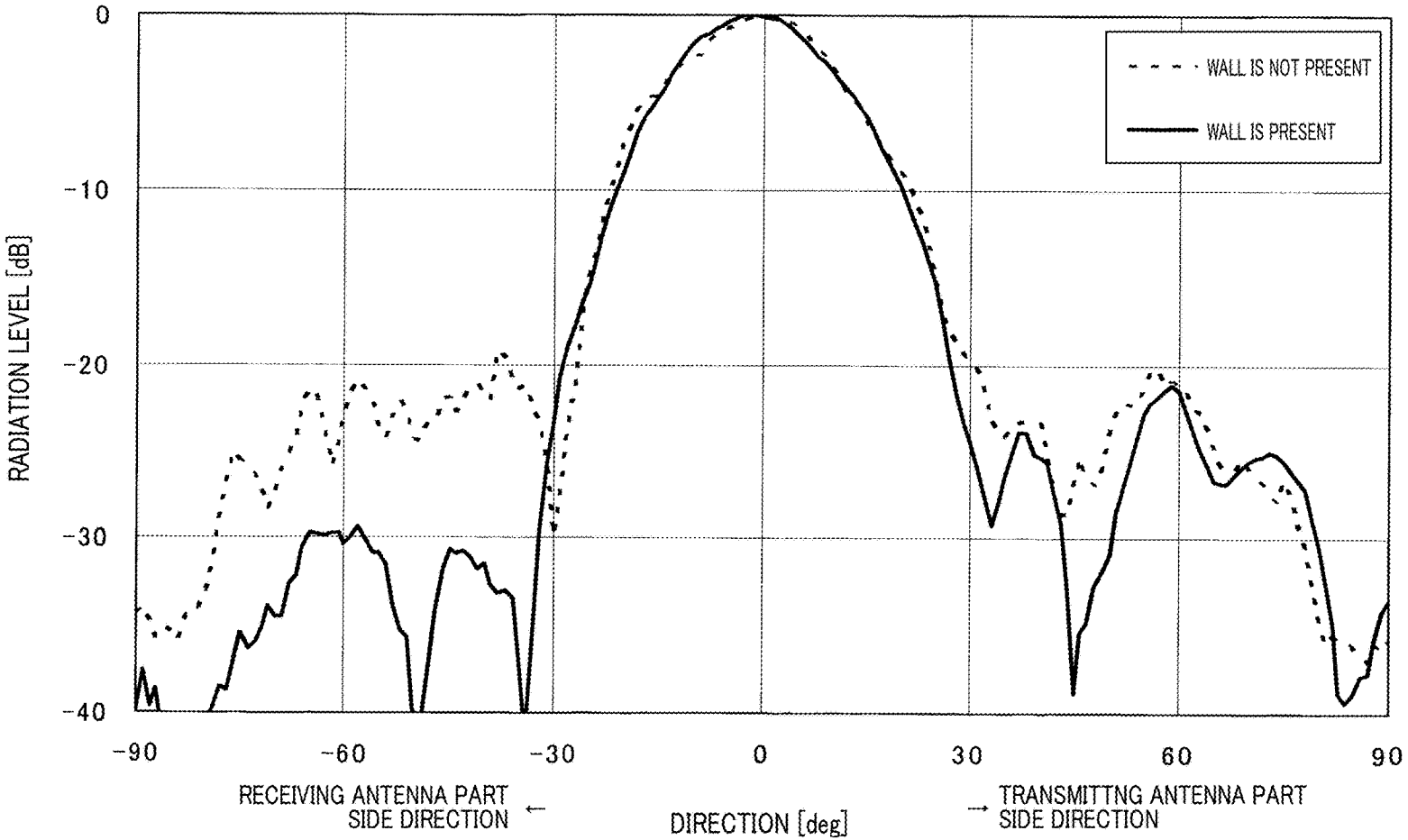
FIG. 17 is a graph showing directivity of the whole transmitting antenna section.
Figure 18:
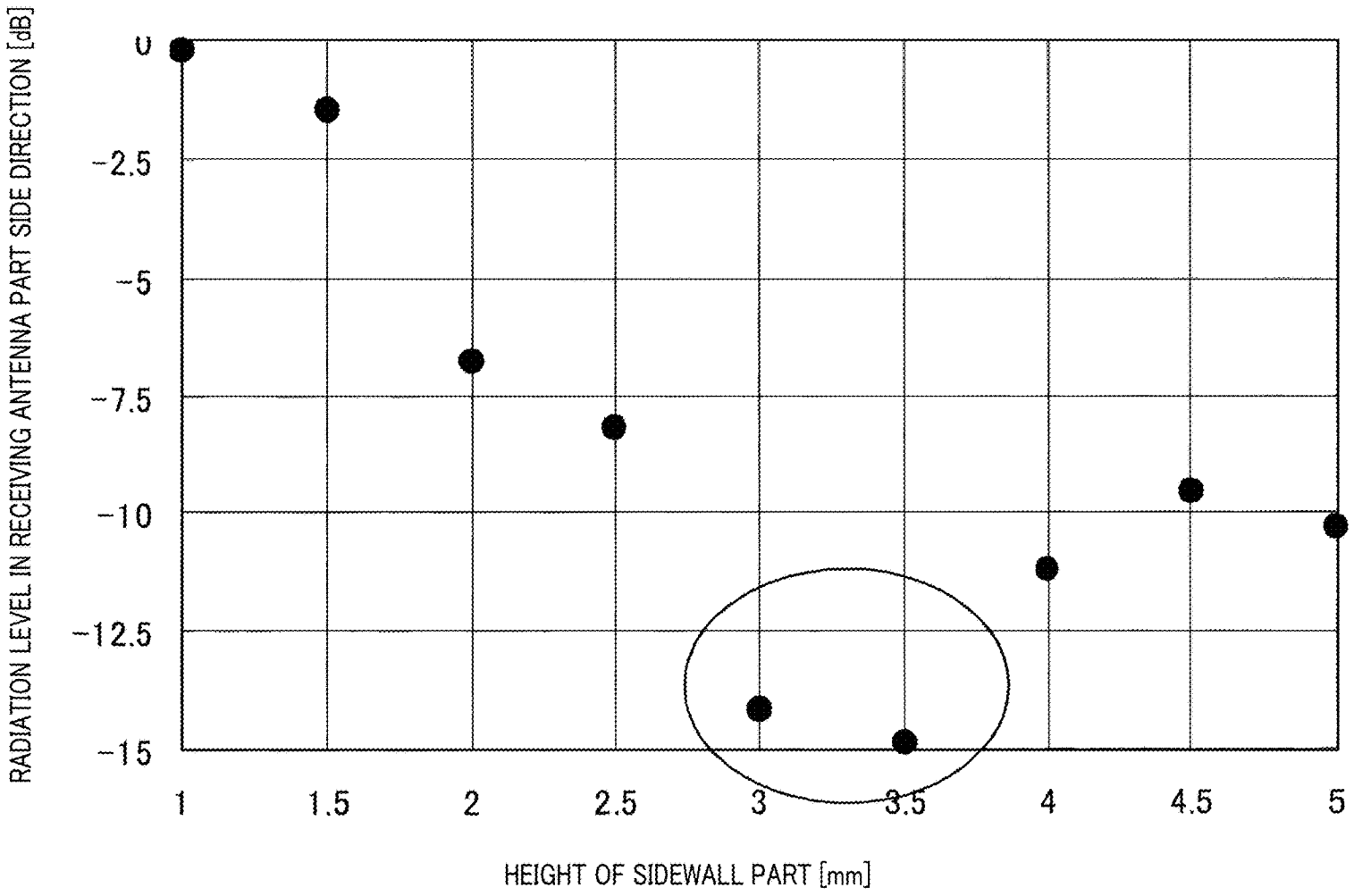
FIG. 18 is a graph showing a relationship between the height of a sidewall part and radiation level in the receiving antenna side direction.

FIGS. 16 to 18 show a result of a simulation.

Note that, in this simulation, on condition that millimeter waves of 76.5 GHz (wavelength λ=3.92 nm) is used, the height of the sidewall part 310 is set to L1=3 [mm], the projection length of the upper wall part 320 is set to L2=6 [mm], and the distance between the undesired radiation source 12*a* and the sidewall part 310 is set to W1=4.7 [mm].

FIG. 16 is a graph of the directivity of the single undesired radiation source 12*a* obtained by the simulation. In FIG. 16, a case where the shielding section 301 exists is shown by a solid line, and a case where the shielding section 301 does not exist is shown by a dashed line. In FIG. 16, it can be seen that, since the shielding section 301 exists, the undesired radiation in the direction between the front side and the receiving antenna side is significantly suppressed, and the undesired radiation intensively appears in the transmitting antenna side direction.

FIG. 17 is a graph of directivity of the whole transmitting antenna section 101 obtained by the simulation. In FIG. 17, a case where the shielding section 301 exists is shown by a solid line, and a case where the shielding section 301 does not exist is shown by a dashed line. In FIG. 17, it can be seen that, undesired radiation from the undesired radiation source 12*a* in the receiving antenna side direction (left side in FIG. 17) is shielded by the shielding section 301, whereby the sidelobes in the receiving antenna side direction with respect to the main lobe are reduced. In addition, in FIG. 17, it can be seen that the sidelobes in the transmitting antenna side direction (right side in FIG. 17) are reduced by interfering with undesired radiation from the undesired radiation source 12*a* which is led by the shielding section 301.

FIG. 18 is a graph which is obtained by simulating the radiation level in the receiving antenna side direction of the transmitting antenna section 101 while changing the height L1 of the sidewall part 310. In FIG. 18, it can be seen that shielding effect in the receiving antenna side direction is maximized in the vicinity of 3 nm (3λ/4).

That is, when designing the antenna apparatus 100, L1=3λ/4 is set, and other parameters (L2, W2) are set by using the result of the simulation or the like so as to satisfy the following conditions (1)(2).

(1) Direct waves from the undesired radiation source 12*a* in the undesired radiation directed from the undesired radiation source 12*a* in the transmitting antenna side direction, and the wave reflected from the shielding section 301 effectively cancel out each other.

(2) The undesired radiation directed from the undesired radiation source 12*a* in the transmitting antenna side direction, and undesired radiation forming sidelobes in the directivity of the radiation elements 110 effectively cancel out each other.

(Eighth Embodiment)

The eighth embodiment is described.

The antenna apparatus 200 of the present embodiment differs from the antenna apparatus 100 only in that the shape of a shielding section 401 differs from the shielding section 301. Hence, the difference is mainly described.

Figure 19:
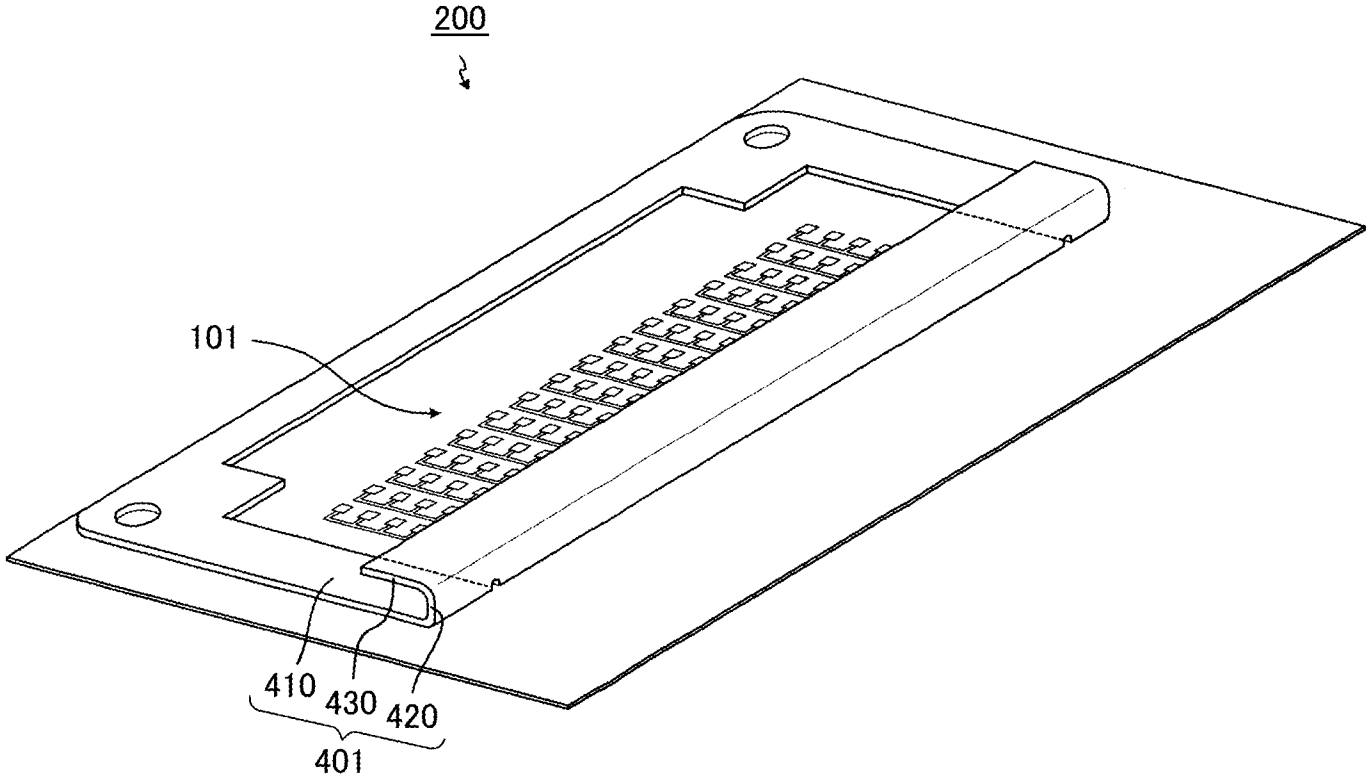
FIG. 19 is a diagram showing a configuration around a transmitting antenna section of an antenna apparatus according to an eighth embodiment.
Figure 20:
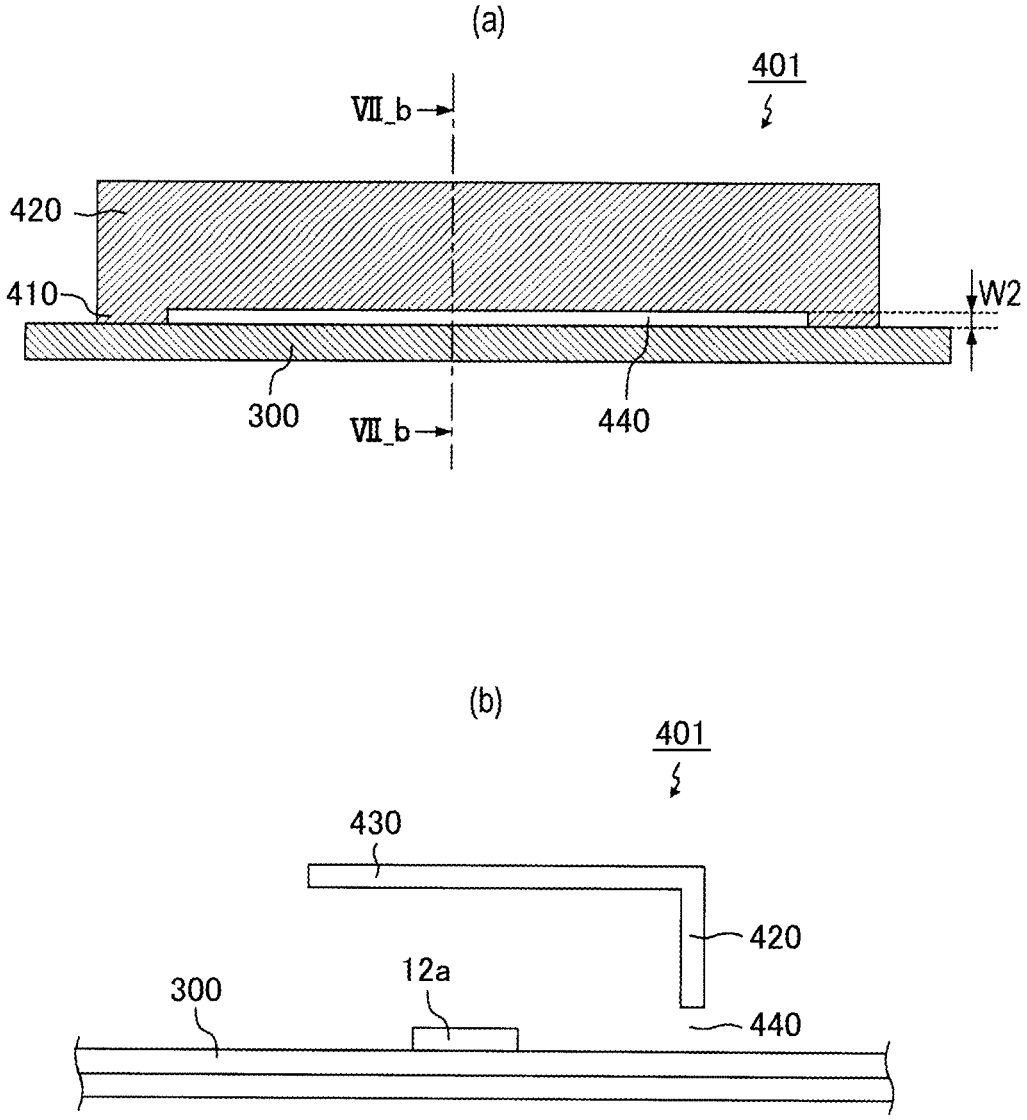
FIG. 20 is an explanatory drawing showing a configuration of a shielding part according to the eighth embodiment; (a) is a diagram viewed from a side where a receiving antenna section is positioned; (b) is a sectional view of the shielding part.

In the antenna apparatus 200, as shown in FIG. 19, the shielding section 401 includes a base part 410, a sidewall part 420 and an upper wall part 430. The base part 410 has a shape which surrounds the transmitting antenna section 101 except the side opposed to the receiving antenna section 201 (hereinafter, referred to as opening side). The sidewall part 420 stands at the end of the opening side of the base part 410. The upper wall part 430 projects from the end of the sidewall part 420 above the undesired radiation source 12*a*. The parts 410 to 430 configuring the shielding section 401 are integrally configured by molding a metal plate. However, as shown in FIG. 20, the sidewall part 420 is integrated with the base part 410 in the vicinity of both ends positioned in the longitudinal direction (Y axis direction). Another port of the sidewall part 420 is provided with a gap (hereinafter, referred to as sidewall lower gap) 440 between the lower end of the sidewall part 420 and the dielectric substrate 300.

According to the antenna apparatus 200 configured as described above, the size of the sidewall lower gap 440 can be appropriately adjusted to regulate the leakage amount of the radio waves from the sidewall lower gap 440, thereby controlling the balance of the sidelobes in the directional characteristics of the transmitting antenna section 101.

Note that, specifically, the size of the sidewall lower gap 440 may be set to the size by which the sidelobes are effectively suppressed, based on the result obtained by simulation or the like.

Figure 21:
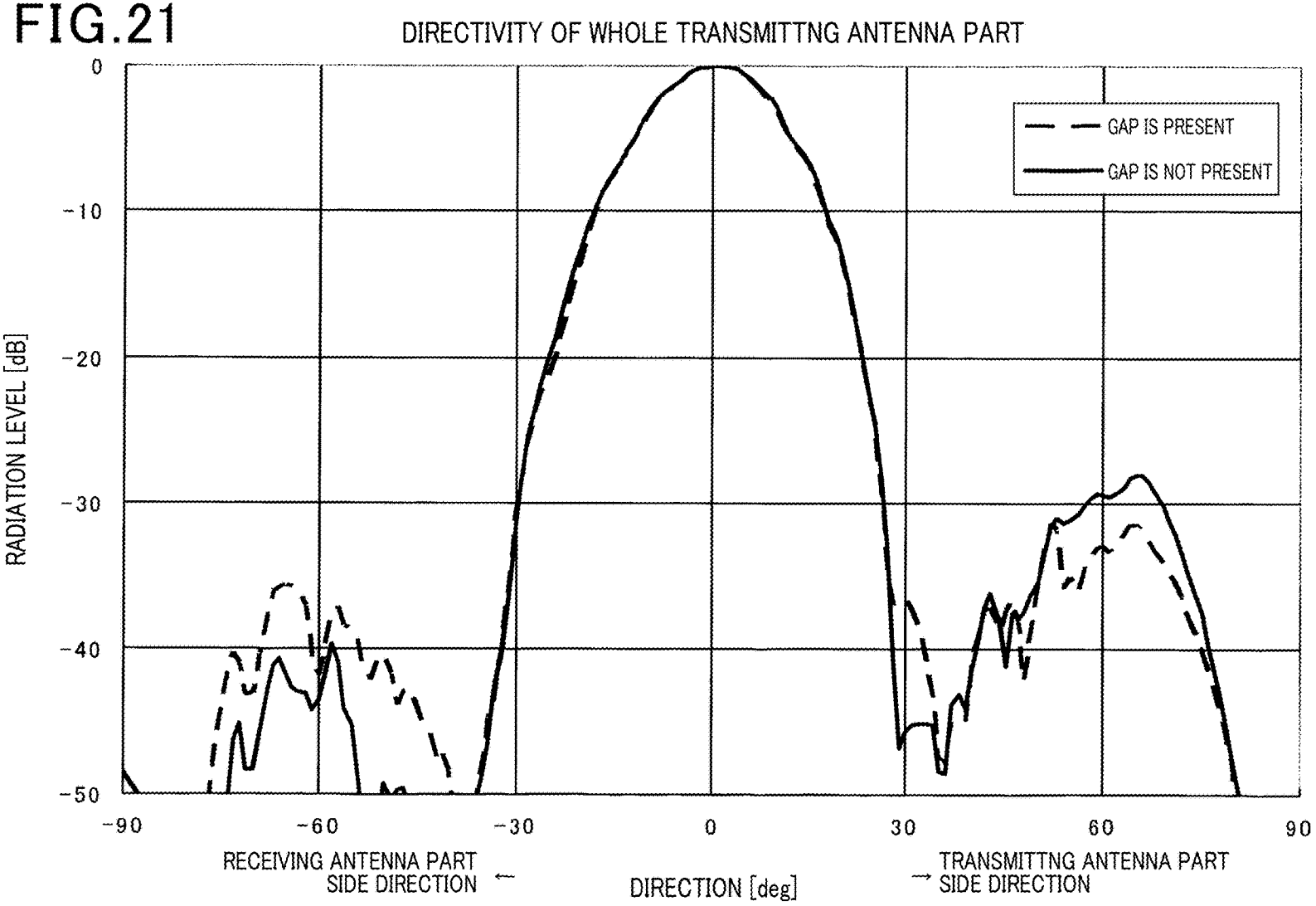
FIG. 21 is a graph showing directivity of the whole transmitting antenna section according to the eighth embodiment.

FIG. 21 is a graph of directivity of the whole transmitting antenna section 101 obtained by simulation. In FIG. 21, a case where the sidewall lower gap 440 does not exist is shown by a solid line, and a case where the sidewall lower gap 440 exists is shown by a dashed line. In this simulation, the size of the sidewall lower gap 440 is set to W2=0.3 [mm].

<Modifications>

The antenna apparatus 200 is configured so that the shielding section 401 is provided with the sidewall lower gap 440.

Figure 22:
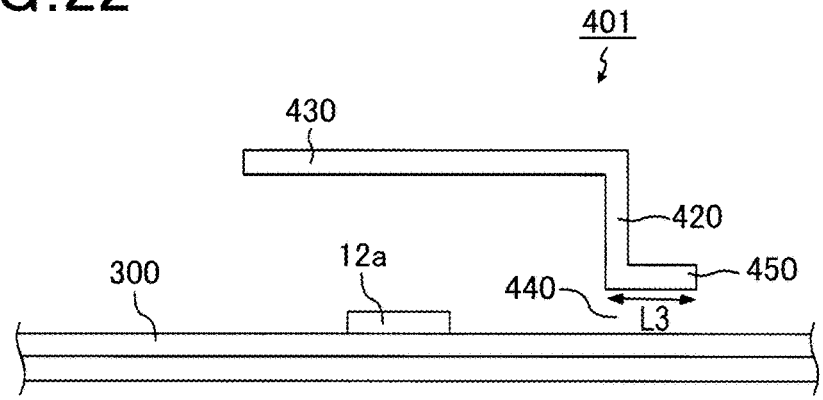
FIG. 22 is a diagram showing a modification of the shielding part shown in the eighth embodiment.

Furthermore, as shown in FIG. 22, above the sidewall lower gap 440, a projection part 450 may be provided which projects from the sidewall part 420 in the direction opposite to the projection direction of the upper wall part 430. The length L3 of the projection part 450 in the projection direction may be set to an odd multiple of λ/4. Thereby, while suppressing leakage of radio waves from the sidewall lower gap 440, not only radiation characteristics of undesired radiation from the undesired radiation source 12*a* but also directivity of the whole transmitting antenna section 101 can be controlled.

(Other Embodiments)

It will be appreciated that, although the embodiments of the present invention are described above, the present invention is not limited to the embodiments, but various embodiments can be implemented.

For example, at least part of the configurations of the above embodiments may be replaced with a known configuration having similar functions.

Figure 23:
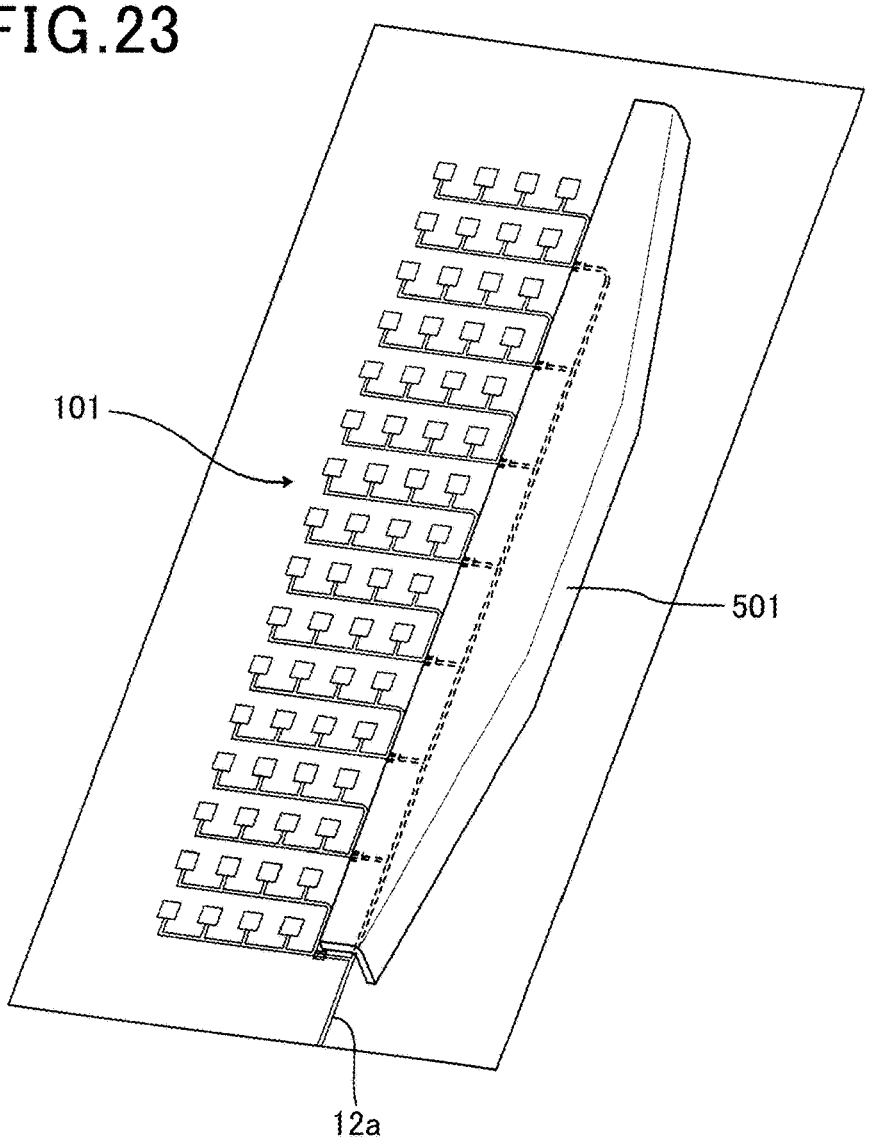
FIG. 23 is a diagram exemplifying another shape of the is shielding part.

In the above embodiments, the sidewall parts 310, 420 of the shielding sections 301, 401 are linearly formed along the main line (undesired radiation source) 12*a* of the feed line 120. However, as in a case of a shielding part 501 shown in FIG. 23, the sidewall part may be formed in a curved shape with respect to the main line 12*a* to accurately control the characteristics of the sidelobes in the directivity of the whole transmitting antenna section 101 by the shape.

The antenna apparatus according to the present embodiment has a dielectric substrate and conductors. The antenna apparatus includes antenna elements which are arranged on a main surface of the dielectric substrate and have directivity ahead of the main surface, and a directional characteristic control member including a sidewall part which projects ahead of the main surface on at least one side of directivity of the antenna elements with respect to the antenna elements, and a roof part which projects in a direction of the antenna elements from the sidewall part at a predetermined angle of more than 70° and less than 120° with respect to the sidewall part so that orthogonal projection to the main surface does not reach the antenna elements, to reflect or absorb radio waves.

Directional characteristics of the antenna element are obtained by assuming one-dimensional characteristics in a plane. Hence, typically, not only three-dimensional directional characteristics in a three-dimensional space but also orthogonal projection to a plane having three-dimensional characteristics may be used as the directional characteristics. The present embodiment assumes, for example, when being applied to a radar installed in a vehicle, directional characteristics in a horizontal plane or a plane inclined at a predetermined angle of elevation with respect to the horizontal plane. The directional characteristic control member may be provided on one or both of the sides of the directional characteristics.

The antenna apparatus of the present embodiment may be an antenna radiating electromagnetic waves or an antenna receiving electromagnetic waves. Alternatively, transmitting antenna elements and receiving antenna elements may be placed side by side. The antenna elements may be used for both transmitting and receiving.

The antenna elements may have any configuration and shape. The antenna element may be a patch antenna or a leaky wave antenna disclosed in JP-A-2012-4700. The antenna element may have any configuration on the condition that directivity thereof has a principal axis (angle of 0°) ahead of, for example, perpendicularly to the main surface of the dielectric substrate. The principal axis of the directional characteristics is not necessarily required to be perpendicular to the main surface of the dielectric substrate but may extend in the direction having an optional angle. The antenna element is, for example, an array antenna, a slot antenna, or a triplate antenna, in which patches are arranged along a dielectric substrate. The shape of the patch for radiating or receiving radio waves is optional.

In addition, the directional characteristic control member may be a member, such as metal, which reflects or shields electromagnetic waves, or a member which absorbs electromagnetic waves. For example, one of a conductive radio-wave absorbing material, a dielectric radio-wave absorbing material, and a magnetic radio-wave absorbing material, or a composite material thereof may be used. The conductive radio-wave absorbing material is, for example, a textile of conductive fibers, and absorbs current generated by radio waves according to resistance in the material. In addition, the dielectric radio-wave absorbing material uses dielectric loss due to polarization reaction of molecules, and may be a material produced by mixing carbon powder or the like with a dielectric such as rubber, urethane foam, and polystyrene foam. In addition, the magnetic radio-wave absorbing material absorbs radio waves by magnetic loss of a magnetic material, and may be a resin produced by kneading plate materials of iron, nickel, and ferrite with powder thereof. In addition, the directional characteristic control member may be a shaped body of a metal, a dielectric radio-wave absorbing material, a dielectric radio-wave absorbing material, and a magnetic radio-wave absorbing material. The directional characteristic control member may be provided, for example, by forming the above material on a shaped body made of resin by plating, coating, or film formation.

In addition, a predetermined angle between the sidewall part and the roof part is desirably 75° or more and 115° or less. Furthermore, 108° or more and 112° or less is desirable. By providing the above range, sidelobes can be effectively suppressed. In addition, the directional characteristic control member is desired to reduce the sidelobes of the antenna element 10 dB or more.

In addition, by determining the height of the sidewall part and the length of the roof part so that an end of the roof part positions on a straight line, which extends from the origin of the directional characteristics of the antenna element and whose inclination has the minimum angle (angle with respect to the principal axis) at which sidelobes appear, the sidelobes can be effectively suppressed. In addition, the directional characteristic control members may be provided at the positions on both sides of the directional characteristics of the antenna element. In addition, the directional characteristic control members may be grounded or not be grounded. In addition, the antenna apparatus of the present embodiment desirably has a grounded conductor formed on the rear surface of the dielectric substrate. The sidewall part is desirably connected to the grounded conductor electrically.

The directional characteristic control member of the present embodiment having the sidewall part and the roof part can effectively suppress sidelobes in the directional characteristics. Compared with a case where the directional characteristic control member does not exist, the sidelobes can be suppressed 10 dB or more. In addition, since the roof part projects toward the antenna element, the height of the sidewall part for suppressing sidelobes can be significantly lowered compared with a case where the roof part does not exist. Hence, the antenna apparatus can be thinned and miniaturized.

In the antenna apparatus of the present embodiment, the radiation element group and the feed line are formed on the same surface of the substrate. Here, the part of the feed line wired along the outer edge of the part, where the radiation element group is formed, is referred to as main line.

In addition, the shielding part is provided on the substrate. The shielding part includes the sidewall part which stands along the main line and on the side opposed to the radiation element group in a state where the main line intervenes between the sidewall part and the radiation element group, and the upper wall part projecting from the sidewall part and above the feed line.

According to the antenna apparatus configured as described above, influence of the undesired radiation from the main line of the feed line is not merely suppressed by the shielding part, but radiation characteristics of the undesired radiation are controlled by the shielding part. Thereby, by using the undesired radiation, the sidelobes generated by the radiation from the radiation element group can be suppressed. That is, characteristics of the apparatus can be improved.

[Reference Signs List]

10 . . . dielectric substrate 20 . . . antenna element 30 . . . ground layer
40a, 40b, 43a, 43b . . . directional characteristic control member
41a, 41b . . . sidewall part 42a, 42b . . . roof part
100, 200 . . . antenna apparatus
300 . . . dielectric substrate
101 . . . transmitting antenna section 110, 210 . . . radiation element
120, 220 . . . feed line 12a . . . main line (undesired radiation source)
12b . . . branch line 201 . . . receiving antenna section
301, 401, 501 . . . shielding part 310, 420 . . . sidewall part
320, 430 . . . upper wall part 410 . . . base part
440 . . . sidewall lower gap 450 . . . projection part

What is claimed is:

1. An antenna apparatus comprising:

a substrate on which a radiation element group including a plurality of radiation elements and a feed line for supplying electricity to each of the radiation elements configuring the radiation element group are formed on the same surface, and a shielding part which includes, in response to a part of the feed line wired along an outer edge of a part, where the radiation element group is formed, being defined as a main line, a sidewall part which stands along the main line and on a side opposed to the radiation element group in a state where the main line intervenes between the sidewall part and the radiation element group, and an upper wall part which projects from the sidewall part and above the feed line, to shield radio waves, wherein the shielding part is interposed between the main line and another feed line, and the shielding part has a shape which has a gap for regulating the leakage amount of undesired radiation from the main line, between the sidewall part and the substrate.

2. The antenna apparatus according to claim 1, wherein in response to a wavelength of a signal transmitted from or received by the radiation element group being λ, the height of the side wall part is set to 3λ/4.

3. The antenna apparatus according to claim 1, further comprising a projection part above the gap, the projection part projecting in a direction opposite to the upper wall part.

4. The antenna apparatus according to claim 3, wherein in response to a wavelength of a signal transmitted from or received by the radiation element group being λ, the length of the projection part in a projecting direction is set to an odd multiple of λ/4.

5. The antenna apparatus according to claim 1, wherein the sidewall of the shielding has a curved shape.

6. The antenna apparatus according to claim 1, wherein the radiation element group configures a transmitting antenna.

7. The antenna apparatus according to claim 6, wherein a receiving antenna is formed on the substrate on a side opposite to the radiation element group and on a same side as the other feed line in a state where the shielding part intervenes between the radiation element group and the receiving antenna.

* * * * *